US011180908B2

(12) United States Patent
Ball et al.

(10) Patent No.: US 11,180,908 B2
(45) Date of Patent: Nov. 23, 2021

(54) DEVICE FOR PROVIDING IMPROVED DRAINAGE

(71) Applicant: WCM Industries, Inc., Colorado Springs, CO (US)

(72) Inventors: William T. Ball, Colorado Springs, CO (US); Eric Pilarczyk, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 41 days.

(21) Appl. No.: 16/583,918

(22) Filed: Sep. 26, 2019

(65) Prior Publication Data

US 2020/0018052 A1 Jan. 16, 2020

Related U.S. Application Data

(63) Continuation of application No. 15/675,306, filed on Aug. 11, 2017, now Pat. No. 10,443,220.

(60) Provisional application No. 62/374,089, filed on Aug. 12, 2016.

(51) Int. Cl.
*E03C 1/244* (2006.01)
*E03C 1/232* (2006.01)

(52) U.S. Cl.
CPC ..... *E03C 1/244* (2013.01); *E03C 1/232* (2013.01)

(58) Field of Classification Search
CPC . E03C 1/24; E03C 1/244; E03C 1/232; E03C 2001/2413
See application file for complete search history.

(56) References Cited

U.S. PATENT DOCUMENTS

| | | | |
|---|---|---|---|
| 37,956 | A | 3/1863 | Dyott |
| 156,971 | A | 11/1874 | Beins et al. |
| 427,478 | A | 5/1890 | McEvoy |
| 437,289 | A | 9/1890 | Clark |
| 569,247 | A | 10/1896 | Smith |
| 608,207 | A | 8/1898 | Merritt |
| 775,020 | A | 11/1904 | Waterman |
| 820,437 | A | 5/1906 | Pehrson |
| 843,968 | A | 2/1907 | Sharp, Jr. |
| 880,939 | A | 3/1908 | Virgo |
| 917,717 | A | 4/1909 | Diedrick |

(Continued)

FOREIGN PATENT DOCUMENTS

| | | |
|---|---|---|
| CA | 530215 | 9/1956 |
| CH | 346187 | 6/1960 |

(Continued)

OTHER PUBLICATIONS

"AB&A Catalog," American Brass & Aluminum Foundry, Inc., Sep. 1, 1995, 28 pages.

(Continued)

*Primary Examiner* — Janie M Loeppke

(57) ABSTRACT

An overflow assembly for a bathtub includes an elbow having a first threaded section and a retainer nut having a second corresponding threaded section. The retainer nut is configured to threadably mount onto the elbow. The overflow assembly further includes an overflow cover including at least one overflow opening and at least one vent opening defined therein. The overflow cover is configured to engage with the retainer nut and substantially cover the first threaded section and the retainer nut.

19 Claims, 13 Drawing Sheets

(56) References Cited

U.S. PATENT DOCUMENTS 938,102 A 10/1909 Wise
952,240 A 3/1910 Deming
964,954 A 7/1910 Coles
1,013,175 A 1/1912 Jones
1,018,021 A 2/1912 Willetts
1,068,039 A 7/1913 Clark
1,173,710 A 2/1916 Crocker et al.
1,173,854 A 2/1916 Pearch
1,213,466 A 1/1917 Delanoy et al.
1,330,909 A 2/1920 Sharp, Jr.
1,331,018 A 2/1920 Luthy
1,371,715 A 3/1921 West
1,518,599 A 12/1924 Murray
1,528,081 A 3/1925 Schermerhorn et al.
1,573,820 A 2/1926 Gade
1,645,027 A 10/1927 Scott
1,669,473 A 5/1928 Kelso
1,692,710 A 11/1928 Spahn
1,712,704 A 5/1929 Kiser
1,760,704 A 5/1930 Lindstrom
1,781,719 A 11/1930 Darling
1,788,083 A 1/1931 Church
1,805,816 A 5/1931 Fleming
1,873,274 A 8/1932 Boosey
1,893,979 A 1/1933 Barrere
1,923,482 A 8/1933 Frankenstein
1,925,008 A 8/1933 Schacht
1,977,177 A 10/1934 De Flores
1,980,493 A 11/1934 Morrisseau
2,016,498 A 10/1935 Hopewell
2,036,614 A 4/1936 Tharp
2,044,253 A 6/1936 Morris
2,045,731 A 6/1936 Solari
2,045,732 A 6/1936 Solari
2,059,532 A 11/1936 Nagel
2,061,553 A 11/1936 Acosta
2,062,145 A 11/1936 Pickop
2,084,437 A * 6/1937 Frankenberger ..... E03C 1/232 4/694
2,096,651 A 10/1937 Salvatore
2,150,483 A 3/1939 Bentz
2,190,532 A 2/1940 Lukonski
2,193,527 A 3/1940 Bentz
2,197,716 A 4/1940 Whitaker
2,222,807 A 11/1940 Burr
2,223,365 A 12/1940 Groeniger
2,278,566 A 4/1942 Schaible
2,323,224 A 6/1943 Kuhnle
2,374,815 A 5/1945 Haas, Jr.
2,444,340 A 6/1948 Donahue
2,462,752 A 2/1949 Kotches
2,570,546 A 10/1950 Hamlett
2,528,919 A 11/1950 Stone et al.
2,580,575 A 1/1952 Muckler
2,664,142 A 12/1953 Scheuerman et al.
2,670,029 A 2/1954 Rossi
2,736,577 A 2/1956 Mackey
2,832,081 A 4/1958 Young
2,890,463 A 6/1959 Young
2,905,951 A 9/1959 Weddendorf, Jr.
2,915,903 A 12/1959 Digby et al.
2,965,153 A 12/1960 Purcell, Sr.
2,966,311 A 12/1960 Davis
2,976,543 A 3/1961 Turner et al.
2,992,437 A 7/1961 Nelson et al.
2,993,655 A 7/1961 O'Brien
RE25,175 E 5/1962 Nelson et al.
3,037,212 A 6/1962 Kleinhof
3,046,028 A 7/1962 Nathan
3,048,415 A 8/1962 Shook
3,082,432 A 3/1963 Pearlman
3,096,527 A 7/1963 Eynon
3,121,879 A 2/1964 Young
3,263,244 A 8/1966 Katz
3,311,391 A 3/1967 Harrell
3,316,562 A 5/1967 Van Dyke et al.
3,345,085 A 10/1967 Hanes
3,349,412 A 10/1967 Schwartz et al.
3,380,081 A 4/1968 Eilertson et al.
3,416,982 A 12/1968 Petzetakis
3,493,978 A 2/1970 Hindman et al.
3,501,172 A 3/1970 Pickard
3,528,112 A 9/1970 Warnick
3,579,670 A 5/1971 Frank
3,608,098 A 9/1971 Andrisani
3,615,984 A 10/1971 Chase
3,684,199 A 8/1972 Bebinger
3,724,507 A 4/1973 Kleykamp et al.
3,742,525 A 7/1973 Oropallo
3,800,339 A 4/1974 Bergin
3,813,708 A 6/1974 Hamburg
3,860,977 A 1/1975 Politz
3,881,201 A 5/1975 Richards
3,911,635 A 10/1975 Traupe
3,937,497 A 2/1976 Studer
3,982,289 A 9/1976 Robbins
4,059,289 A 11/1977 Morris et al.
4,087,127 A 5/1978 Lotta
D248,133 S 6/1978 Shames et al.
4,092,745 A 6/1978 Oropallo
4,123,810 A 11/1978 Oropallo
4,127,904 A 12/1978 Junker
4,135,258 A 1/1979 Braga et al.
4,146,939 A 4/1979 Izzi
4,194,251 A 3/1980 Pennerstorfer
4,207,632 A 6/1980 Saveli, Jr. et al.
4,232,407 A 11/1980 Williams
4,233,697 A 11/1980 Cornwall
4,238,860 A 12/1980 Dixon
4,240,166 A 12/1980 Altman et al.
4,257,892 A 3/1981 Boersma
4,294,370 A 10/1981 Toeppen
4,307,901 A 12/1981 Orberg et al.
4,310,933 A 1/1982 Stratman
4,320,540 A 3/1982 Leavens
4,329,744 A 5/1982 Cuschera
4,352,213 A 10/1982 Watts
4,359,788 A 11/1982 Liou
4,359,790 A 11/1982 Chalberg
4,371,991 A 2/1983 Schrott
4,387,914 A 6/1983 Paulson et al.
4,412,361 A 11/1983 Cuschera
4,413,384 A 11/1983 Lassche
4,457,030 A 7/1984 Burry
4,470,437 A 9/1984 Rabinovich
4,475,256 A 10/1984 Hatala
4,502,166 A 3/1985 Brown, Sr.
4,505,499 A 3/1985 Uglow et al.
4,520,515 A 6/1985 Hatala
4,542,642 A 9/1985 Tagliarino
4,553,625 A 11/1985 Tsuge et al.
4,571,751 A 2/1986 Barlow
4,574,402 A 3/1986 Brown, Sr.
4,574,409 A 3/1986 McAffrey
4,594,738 A 6/1986 Gebert
4,594,740 A 6/1986 Tseronakis
4,599,784 A 7/1986 Canu, Jr. et al.
4,660,860 A 4/1987 Todd
4,683,597 A 8/1987 Taylor et al.
4,692,948 A 9/1987 Martin
4,706,306 A 11/1987 Smith
4,706,482 A 11/1987 Barber
4,720,877 A 1/1988 Watts
4,722,556 A 2/1988 Todd
4,730,855 A 3/1988 Pelletier
D296,816 S 7/1988 Budzinski et al.
4,763,510 A 8/1988 Palmer
4,796,926 A 1/1989 Rapsilver
4,799,713 A 1/1989 Uglow et al.
4,813,745 A 3/1989 Woody
4,825,477 A 5/1989 Aranda
4,850,617 A 7/1989 Moberly
4,865,353 A 9/1989 Osborne
4,890,967 A 1/1990 Rosenbaum

(56) References Cited

U.S. PATENT DOCUMENTS 4,920,582 A 5/1990 Alker
4,936,350 A 6/1990 Huber
4,945,579 A 8/1990 Husting
4,953,235 A 9/1990 Cornwall
5,025,509 A 6/1991 Holt et al.
5,076,095 A 12/1991 Erhardt
5,115,554 A 5/1992 Fell, Sr.
5,123,123 A 6/1992 Hart et al.
5,163,480 A 11/1992 Huber
5,165,118 A 11/1992 Cendrowski
5,228,153 A 7/1993 Frankel
D341,410 S 11/1993 Molinaro
5,257,648 A 11/1993 Oropallo
5,265,281 A 11/1993 McAlpine
5,267,474 A 12/1993 Hoven
5,271,108 A 12/1993 Wicke
5,273,077 A 12/1993 Oropallo
5,291,619 A 3/1994 Adorjan
5,295,760 A 3/1994 Rowe
5,297,817 A 3/1994 Hodges
5,318,230 A 6/1994 Ferguson et al.
5,324,001 A 6/1994 Duke
5,330,811 A 7/1994 Buchalter
5,350,266 A 9/1994 Espey et al.
5,351,996 A 10/1994 Martin
5,363,519 A 11/1994 Husting
5,369,815 A 12/1994 Martin
5,372,715 A 12/1994 Maggard et al.
5,376,264 A 12/1994 Betancourt
5,377,361 A 1/1995 Piskula
5,417,460 A 5/1995 Lunder
5,418,983 A 5/1995 Garguillo et al.
5,442,819 A 8/1995 Penor et al.
5,495,750 A 3/1996 Dufresne
5,497,514 A 3/1996 Miller
5,497,516 A 3/1996 Irwin
5,507,501 A 4/1996 Palmer
5,509,148 A 4/1996 Steele et al.
5,535,455 A 7/1996 Liu
D373,623 S 9/1996 Mathison
5,560,052 A 10/1996 Ferguson et al.
5,581,018 A 12/1996 Allen et al.
5,590,916 A 1/1997 Liu
D381,405 S 7/1997 Waidele et al.
5,661,462 A 8/1997 Shrewsbury-Gee
5,682,620 A 11/1997 Stoltz et al.
5,692,248 A 12/1997 Ball
5,740,830 A 4/1998 Mankins
5,745,931 A 5/1998 Ball
5,758,368 A 6/1998 Ball
5,786,054 A 7/1998 Platusich et al.
5,799,986 A 9/1998 Corbett et al.
5,815,895 A 10/1998 Carlson et al.
5,819,328 A 10/1998 Lewis
5,881,397 A 3/1999 Hobbs
5,890,241 A 4/1999 Ball
5,924,635 A 7/1999 Koshimizu et al.
5,931,184 A 8/1999 Armenia et al.
5,937,450 A 8/1999 Jones
5,944,985 A 8/1999 Bowman
5,957,514 A 9/1999 Brookshire
5,971,438 A 10/1999 Johnson
5,997,049 A 12/1999 Kingsford et al.
6,058,525 A 5/2000 Paden
6,058,526 A 5/2000 Parisi et al.
6,062,254 A 5/2000 Brady et al.
6,066,119 A 5/2000 Ball
6,067,669 A 5/2000 Peterson et al.
6,070,910 A 6/2000 Hodges
6,073,278 A 6/2000 Ball
6,076,545 A 6/2000 Cooper
D428,133 S 7/2000 Chen
6,085,362 A 7/2000 Huber
6,085,363 A 7/2000 Huber
6,088,843 A 7/2000 Francisco
6,098,212 A 8/2000 Rogan
6,105,183 A 8/2000 Bly
6,108,828 A 8/2000 Cheng
6,126,233 A 10/2000 Gaetano et al.
6,138,290 A 10/2000 Lin
6,138,298 A 10/2000 Ball
6,145,136 A 11/2000 Parisi et al.
6,148,454 A 11/2000 Ball
6,154,898 A 12/2000 Ball
6,158,809 A 12/2000 Gobbers et al.
6,173,459 B1 1/2001 Ball
6,185,755 B1 2/2001 Shepherd et al.
6,192,531 B1 2/2001 Fritz et al.
6,193,879 B1 2/2001 Bowman
6,195,819 B1 3/2001 Wang
6,205,594 B1 3/2001 Solaberry
6,216,288 B1 4/2001 Bernau
6,226,806 B1 5/2001 Ball
6,263,518 B1 7/2001 Magtanong
6,269,495 B1 8/2001 Sondrup
6,272,699 B1 8/2001 Peterson
6,289,532 B1 9/2001 Fritz et al.
6,295,659 B1 10/2001 Sandness
6,295,664 B2 10/2001 Fritz et al.
6,317,906 B1 11/2001 Ball
6,332,632 B1 12/2001 Hodges
6,338,168 B1 1/2002 Valentine
6,362,734 B1 3/2002 McQuade et al.
6,378,912 B1 4/2002 Condon et al.
6,418,570 B1 7/2002 Ball
6,448,907 B1 9/2002 Naclerio
6,484,331 B2 11/2002 Minnick
6,490,739 B1 12/2002 Lee
6,508,490 B1 1/2003 Hoffman
6,510,860 B2 1/2003 Kihs
6,530,722 B1 3/2003 Shaw et al.
6,546,573 B1 4/2003 Ball
6,592,669 B2 7/2003 Damrau
6,606,753 B2 8/2003 Minnick
6,618,875 B1 * 9/2003 Oropallo ..... E03C 1/24 4/694
6,622,317 B1 9/2003 Oropallo et al.
6,631,623 B1 10/2003 Ball
6,637,050 B1 10/2003 Ball
6,640,358 B2 11/2003 Ball
6,675,406 B2 1/2004 Ball
6,675,407 B1 1/2004 Ball
6,681,420 B1 1/2004 Ball
6,687,926 B1 2/2004 Bayley
6,691,411 B2 2/2004 Ball
6,696,943 B1 2/2004 Elrod et al.
6,719,294 B2 4/2004 Nguyen et al.
6,735,791 B1 5/2004 Lordahi et al.
6,789,275 B2 9/2004 Spells, Sr. et al.
6,795,987 B2 9/2004 Cornwall
6,799,606 B1 10/2004 Howson
6,800,024 B1 10/2004 Prevost
6,812,844 B1 11/2004 Burgess
6,823,540 B2 11/2004 Gunn
6,836,911 B2 1/2005 Minnick
6,880,179 B2 4/2005 Wang
6,895,838 B2 5/2005 Stahnke
6,901,611 B2 6/2005 McEntire et al.
6,953,049 B2 10/2005 Kowalke
D517,666 S 3/2006 Wilk, Jr. et al.
7,013,500 B1 3/2006 Lin
7,017,199 B2 3/2006 Oropallo et al.
D523,123 S 6/2006 Wilk, Jr. et al.
7,055,184 B2 6/2006 Humber
7,096,522 B2 8/2006 Hirtriter
7,127,752 B2 10/2006 Ball
7,185,529 B2 3/2007 Ball
7,188,376 B2 3/2007 Ortiz et al.
7,210,493 B1 5/2007 Wang
7,237,280 B1 7/2007 Holden, Jr. et al.
D549,805 S 8/2007 Quach
7,300,074 B1 11/2007 Paulson
7,328,953 B2 2/2008 Werschmidt
7,341,286 B2 3/2008 Andre

(56) References Cited

U.S. PATENT DOCUMENTS

| | | | |
|---|---|---|---|
| 7,343,923 | B2 | 3/2008 | Foster |
| 7,451,502 | B2 | 11/2008 | Ball |
| D586,433 | S | 2/2009 | Price et al. |
| 7,503,083 | B2 | 3/2009 | Ball |
| 7,506,385 | B2 | 3/2009 | Werschmidt |
| 7,549,702 | B2 | 6/2009 | Meyers |
| D599,447 | S | 9/2009 | Cummings et al. |
| 7,740,197 | B1 | 6/2010 | Schulz |
| 7,774,871 | B1 | 8/2010 | Arsenault |
| 7,814,580 | B2 | 10/2010 | Coronado et al. |
| D627,862 | S | 11/2010 | Ball |
| D627,863 | S | 11/2010 | Ball |
| 7,856,677 | B1 | 12/2010 | Harris |
| D636,468 | S | 4/2011 | Ball |
| D637,696 | S | 5/2011 | Ball et al. |
| 7,963,568 | B2 | 6/2011 | Jensen |
| 8,028,357 | B2 | 10/2011 | Ball |
| D652,122 | S | 1/2012 | Bonhag et al. |
| D659,809 | S | 5/2012 | Smith |
| 8,166,584 | B2 | 5/2012 | Ball |
| D665,062 | S | 8/2012 | Ball |
| 8,266,735 | B2 | 9/2012 | McLeod |
| 8,302,220 | B2 | 11/2012 | Ball |
| 8,321,970 | B2 | 12/2012 | Ball |
| D674,883 | S | 1/2013 | Ball |
| 8,347,906 | B1 | 1/2013 | Ismert et al. |
| 8,505,132 | B2 | 8/2013 | Ball |
| 8,584,272 | B2 | 11/2013 | Ball |
| 8,607,376 | B2 | 12/2013 | Ball |
| D705,402 | S | 5/2014 | Yu |
| 8,756,724 | B1 | 6/2014 | Lordahi et al. |
| 8,769,736 | B2 | 7/2014 | Ball |
| 8,925,123 | B2 | 1/2015 | DeGooyer et al. |
| 9,015,870 | B2 | 4/2015 | Ball |
| 9,015,876 | B2 | 4/2015 | Ball |
| D729,257 | S | 5/2015 | Ball |
| 9,045,886 | B2 | 6/2015 | Ball |
| 9,074,358 | B2 | 7/2015 | Ball et al. |
| 9,157,220 | B2 | 10/2015 | Ball |
| 9,200,436 | B2 | 12/2015 | Ball |
| 9,267,274 | B2 | 2/2016 | Ball |
| 9,663,930 | B2 | 5/2017 | Ball |
| 10,544,572 | B2 * | 1/2020 | Humber ..... E03C 1/244 |
| 10,563,385 | B1 | 2/2020 | Ball |
| 2001/0002494 | A1 | 6/2001 | Fritz et al. |
| 2002/0023294 | A1 | 2/2002 | Spells, Sr. |
| 2002/0032926 | A1 | 3/2002 | Lewis |
| 2002/0112285 | A1 | 8/2002 | Minnick |
| 2002/0121982 | A1 | 9/2002 | Ferris et al. |
| 2003/0000012 | A1 | 1/2003 | Ball |
| 2003/0024568 | A1 | 2/2003 | Bowman |
| 2003/0025275 | A1 | 2/2003 | Miller |
| 2003/0051343 | A1 | 3/2003 | Ball |
| 2003/0151281 | A1 | 8/2003 | Williams |
| 2003/0182721 | A1 | 10/2003 | Li |
| 2003/0192115 | A1 | 10/2003 | Oropallo et al. |
| 2004/0012197 | A1 | 1/2004 | Guillaud et al. |
| 2004/0034926 | A1 | 2/2004 | Ball |
| 2004/0055083 | A1 | 3/2004 | Ball |
| 2004/0055084 | A1 | 3/2004 | Ball |
| 2004/0068792 | A1 | 4/2004 | Ball |
| 2004/0068793 | A1 | 4/2004 | Ball |
| 2004/0103474 | A1 | 6/2004 | Ball |
| 2004/0111797 | A1 | 6/2004 | Ball |
| 2004/0117907 | A1 | 6/2004 | Ball |
| 2004/0128757 | A1 | 7/2004 | Ball |
| 2004/0163165 | A1 | 8/2004 | Ortiz et al. |
| 2005/0022300 | A1 | 2/2005 | McEntire et al. |
| 2005/0035558 | A1 | 2/2005 | Dipzinski et al. |
| 2005/0050623 | A1 | 3/2005 | Greene |
| 2005/0108814 | A1 | 5/2005 | Thompson |
| 2006/0085907 | A1 | 4/2006 | Ball |
| 2006/0096018 | A1 | 5/2006 | Ball |
| 2006/0096019 | A1 | 5/2006 | Ball |
| 2006/0170208 | A1 | 8/2006 | Arning et al. |
| 2006/0218992 | A1 | 10/2006 | Ball |
| 2006/0283792 | A1 | 12/2006 | McCallum |
| 2007/0007763 | A1 | 1/2007 | Deaton |
| 2007/0039098 | A1 | 2/2007 | Ball |
| 2007/0044218 | A1 | 3/2007 | Ball |
| 2007/0044230 | A1 | 3/2007 | Ball |
| 2007/0130689 | A1 | 6/2007 | Condon et al. |
| 2008/0028514 | A1 | 2/2008 | Lock et al. |
| 2008/0047060 | A1 | 2/2008 | Ball |
| 2008/0098504 | A1 | 5/2008 | Knox et al. |
| 2008/0098517 | A1 | 5/2008 | Ball |
| 2008/0148469 | A1 | 6/2008 | Dipzinski et al. |
| 2008/0148477 | A1 | 6/2008 | Shafik |
| 2008/0155745 | A1 | 7/2008 | Burr |
| 2008/0196161 | A1 | 8/2008 | Ball |
| 2008/0235866 | A1 | 10/2008 | Ball |
| 2009/0119826 | A1 | 5/2009 | Coronado |
| 2009/0172877 | A1 | 7/2009 | Ball |
| 2009/0173396 | A1 | 7/2009 | Spadavecchia |
| 2009/0250120 | A1 | 10/2009 | Robbins |
| 2009/0260154 | A1 | 10/2009 | Shoop et al. |
| 2009/0261579 | A1 | 10/2009 | Spears |
| 2010/0037392 | A1 | 2/2010 | Ball et al. |
| 2010/0163131 | A1 | 7/2010 | Fehr et al. |
| 2011/0035867 | A1 | 2/2011 | Coronado et al. |
| 2011/0154566 | A1 | 6/2011 | Shafik |
| 2011/0173747 | A1 | 7/2011 | Evans et al. |
| 2011/0209279 | A1 | 9/2011 | Ball |
| 2011/0289667 | A1 | 12/2011 | Oropallo et al. |
| 2012/0005824 | A1 | 1/2012 | Ball |
| 2012/0048070 | A1 | 3/2012 | Richter |
| 2012/0079654 | A1 | 4/2012 | Ball |
| 2012/0090084 | A1 | 4/2012 | Ball |
| 2012/0204345 | A1 | 8/2012 | Ball |
| 2012/0246822 | A1 | 10/2012 | Ball |
| 2013/0031720 | A1 | 2/2013 | Homami |
| 2013/0055494 | A1 | 3/2013 | Ball |
| 2013/0067648 | A1 | 3/2013 | Whitehead |
| 2013/0069361 | A1 | 3/2013 | Cai et al. |
| 2013/0180045 | A1 | 7/2013 | Ball et al. |
| 2013/0191988 | A1 | 8/2013 | Ball |
| 2013/0193042 | A1 | 8/2013 | Hull |
| 2013/0269100 | A1 | 10/2013 | Ball et al. |
| 2013/0283523 | A1 | 10/2013 | Ball |
| 2013/0340163 | A1 | 12/2013 | Ball et al. |
| 2014/0101834 | A1 | 4/2014 | Ball |
| 2014/0138297 | A1 | 5/2014 | Hull |
| 2014/0223659 | A1 * | 8/2014 | Gay ..... E03C 1/244 4/694 |
| 2015/0089736 | A1 | 4/2015 | Bird |
| 2015/0121617 | A1 | 5/2015 | Ball |
| 2015/0152627 | A1 | 6/2015 | Ball |
| 2015/0233103 | A1 | 8/2015 | Ball |
| 2015/0275487 | A1 | 10/2015 | Ball |
| 2016/0348810 | A1 | 12/2016 | Kipp |
| 2017/0247867 | A1 | 8/2017 | Ball |
| 2018/0044899 | A1 | 2/2018 | Ball et al. |
| 2019/0376267 | A1 | 12/2019 | Ball |
| 2020/0232198 | A1 | 7/2020 | Ball |

FOREIGN PATENT DOCUMENTS

| | | |
|---|---|---|
| DE | 419477 | 9/1925 |
| DE | 1163257 | 3/1964 |
| DE | 1784266 | 10/1971 |
| DE | 3138912 | 4/1983 |
| DE | 3621715 | 1/1988 |
| DE | 9200488 | 3/1992 |
| DE | 4206903 | 9/1993 |
| DE | 3603877 | 1/1997 |
| DE | 20118252 | 3/2003 |
| EP | 0845559 | 6/1998 |
| FR | 744099 | 4/1933 |
| FR | 1191141 | 10/1959 |
| FR | 2643097 | 8/1990 |
| GB | 1216208 | 12/1970 |
| GB | 1216285 | 12/1970 |
| GB | 2263060 | 7/1993 |
| GB | 2338184 | 12/1999 |

(56) References Cited

FOREIGN PATENT DOCUMENTS

| | | |
|---|---|---|
| JP | S53-58752 | 5/1978 |
| JP | H02-144074 | 12/1990 |
| JP | H05-15887 | 3/1993 |
| JP | H05-88393 | 12/1993 |
| JP | H09-108130 | 4/1997 |
| JP | 2000-513421 | 10/2000 |
| JP | 2003-313913 | 11/2003 |
| WO | WO 1999/24738 | 5/1999 |
| WO | WO 99/54560 | 10/1999 |
| WO | WO 02/063109 | 8/2002 |
| WO | WO 2004/074587 | 9/2004 |
| WO | WO 2009/063334 | 5/2009 |
| WO | WO 2013/112560 | 8/2013 |

OTHER PUBLICATIONS

"Geberit Installation Manual," Geberit, Dec. 12, 2012, 10 pages.
"New WATCO Eliminator Bath Waste", WATCO, as early as Aug. 8, 2001, pp. 1-2.
"OATEYSCS Supply Chain Services Catalog," Oatey Co., 2012, 334 pages.
"PRESS-IN" Trim Kit, AB&A™ IPS Corporation (date unknown) 2 pages.
"Push N' Repair Closet Flange," IPS Corporation, 2011, [retrieved Sep. 6, 2014], 1 page. Retrieved from: http://web.archive.org/web/20111013024522/http://ipscorp.com/watertite/cl-osetflanges/pushnrepair.
"PVC Scheduling 80 Fittings," Spears Manufacturing Co., May 28, 1996, 2 pages.
"Tubular Plastic-Innovator® 590", Woodford Manufacturing Company, first sold Aug. 16, 2001, pp. 1-2.
"Ultralite® —Type NM (Liquidtight Flexible Nonmetallic Conduit)", Southwire Company brochure/pamphlet, as early as 2003, printed on Dec. 14, 2008, pp. 1-3.
"WCM Industries-Freezeless Faucets, Yard Hydrants and Bath Wastes", as early as Aug. 2000, available at http://www.woodfordmfg.com/, printed on Sep. 15, 2005, p. 1.
"Why choose a Geberit Cable Driven Bath Waste Overflow?" Geberit, date unknown, 2 pages.
Answer and Counterclaim, *WCM Industries, Inc.* v. *IPS Corporation, et al.*, U.S. District Court, Western District of Tennessee, Western Division, Case No. 2:13-cv-02019-JPM-tmp, filed Feb. 19, 2013, 16 pages.
Canadian Examiner's Report for Application No. 2,556,523, dated Feb. 16, 2009, 2 pages.
Canadian Notice of Allowance for Patent Application No. 2,557,022, dated Mar. 17, 2009, 1 page.
Canadian Official Action for Patent Application No. 2,557,022, dated Nov. 28, 2008, 2 pgs.
Canadian Official Action for Patent Application No. 2,642,379, dated Nov. 7, 2014, 3 pages.
Complaint (with Exhibits A-J), *WCM Industries, Inc.* v. *IPS Corporation, et al.*, U.S. District Court, Western District of Tennessee, Western Division, Case No. 2:13-cv-02019-JPM-tmp, filed Jan. 9, 2013, 117 pages.
Complaint for Delaratory Relief (with Exhibits 1-7), *IPS Corporation* v. *WCM Industries, Inc.*, United States District Court for the Western District of Tennessee, Case No. 2:12-cv-02694, filed Aug. 9, 2012, 58 pages.
Declaration of Wolpert and Exhibits A-D, *WCM Industries, Inc.* v. *IPS Corporation, et al.*, U.S. District Court, Western District of Tennessee, Western Division, Case No. 2:13-cv-02019-JPM-dkv, Oct. 22, 2014, 21 pages.
Defendant WCM Industries, Inc's Answer to Complaint, Affirmative Defenses and Counterclaims Against IPS Corporation, *IPS Corporation* v. *WCM Industries, Inc.*, United States District Court for the Western District of Tennessee, Case No. 2:12-cv-02694-JPM-tmp, filed Apr. 12, 2013, 10 pages.
Definition of the term "diaphragm" found at: http://www.thefreedictionary.com/diaphragm, cited in Aug. 7, 2012 OA for U.S. Appl. No. 13/234,030.
European Extended Search Report in Application 12002970.7, dated Mar. 25, 2014, 9 pages.
Great Britain Examination and Search Report for United Kingdom Patent Application No. GB1118043.7, dated Oct. 31, 2011 6 pages.
IPS Corporation's Initial Non-Infringement Contentions (with Exhibit A), *IPS Corporation* v. *WCM Industries, Inc.*, United States District Court for the Western District of Tennessee, Case No. 2:12-cv-02694-JPM-dkv, dated Jun. 7, 2013, 5 pages.
Mexican Notice of Allowance for Patent Application No. MX/a/2008/013956, dated Nov. 16, 2011, 1 page.
Mexican Official Action (with partial English summary) for Mexican Patent Application No. MX/a/2012/002782 dated Dec. 1, 2014, 3 pages.
Mexican Official Action for Patent Application No. PA/a/2005/011301, dated Mar. 18, 2010 3 pages.
Mexican Official Action for Patent Application No. PA/a/2005/011301, dated Oct. 20, 2010, 2 pgs.
PCT International Search Report for International Patent Application No. PCT/US03/09439, dated Sep. 9, 2003, 1 page.
Plaintiff IPS Corporation's Answer To Defendant WCM Industries, Inc's Counterclaims, *IPS Corporation* v. *WCM Industries, Inc.*, United States District Court for the Western District of Tennessee, Case No. 2:12-cv-02694-JPM-tmp, filed May 3, 2013, 5 pages.
Plaintiff IPS's Final Invalidity Contentions (Exhibit A), *IPS Corporation* v. *WCM Industries, Inc.*, United States District Court for the Western District of Tennessee, Case No. 2:12-cv-02694-JPM-dkv, dated Feb. 23, 2015, 3 pages.
Plaintiff IPS's Final Invalidity Contentions (Exhibit B-1), *IPS Corporation* v. *WCM Industries, Inc.*, United States District Court for the Western District of Tennessee, Case No. 2:12-cv-02694-JPM-dkv, dated Feb. 23, 2015, 951 pages.
Plaintiff IPS's Final Invalidity Contentions (Exhibit B-2), *IPS Corporation* v. *WCM Industries, Inc.*, United States District Court for the Western District of Tennessee, Case No. 2:12-cv-02694-JPM-dkv, dated Feb. 23, 2015, 1003 pages.
Plaintiff IPS's Final Invalidity Contentions (Exhibit B-3), *IPS Corporation* v. *WCM Industries, Inc.*, United States District Court for the Western District of Tennessee, Case No. 2:12-cv-02694-JPM-dkv, dated Feb. 23, 2015, 351 pages.
Plaintiff IPS's Final Invalidity Contentions (Exhibit B-7), *IPS Corporation* v. *WCM Industries, Inc.*, United States District Court for the Western District of Tennessee, Case No. 2:12-cv-02694-JPM-dkv, dated Feb. 23, 2015, 531 pages.
Plaintiff IPS's Final Invalidity Contentions (Exhibit B-8), *IPS Corporation* v. *WCM Industries, Inc.*, United States District Court for the Western District of Tennessee, Case No. 2:12-cv-02694-JPM-dkv, dated Feb. 23, 2015, 1219 pages.
Plaintiff IPS's Final Invalidity Contentions, *IPS Corporation* v. *WCM Industries, Inc.*, United States District Court for the Western District of Tennessee, Case No. 2:12-cv-02694-JPM-dkv, dated Feb. 23, 2015, 17 pages.
Plaintiff IPS's Initial Invalidity Contentions (with Exhibits A and B), *IPS Corporation* v. *WCM Industries, Inc.*, United States District Court for the Western District of Tennessee, Case No. 2:12-cv-02694-JPM-dkv, dated Aug. 6, 2013, 78 pages.
Reply to Defendant's Counterclaims, *WCM Industries, Inc.* v. *IPS Corporation, et al.*, U.S. District Court, Western District of Tennessee, Western Division, Case No. 2:13-cv-02019-JPM-tmp, filed Mar. 12, 2013, 4 pages.
U.S. Appl. No. 09/593,724 entitled "Method and Means Foran Overflow Assembly To Bathtubs and the Like", by William T. Ball, filed Jun. 13, 2000, 14 pages.
U.S. Appl. No. 10,326,449, Office Action dated Jan. 13, 2004, 8 pages.
U.S. Appl. No. 10,326,449, Office Action dated Oct. 15, 2003, 7 pages.
U.S. Appl. No. 10,326,449, Office Action dated Jun. 4, 2003, 6 pages.
U.S. Appl. No. 10/247,247, Office Action dated Dec. 4, 2006, 9 pages.

(56) References Cited

OTHER PUBLICATIONS

U.S. Appl. No. 10/247,247, Office Action dated Feb. 17, 2006, 10 pages.
U.S. Appl. No. 10/247,247, Office Action dated Apr. 5, 2004, 8 pages.
U.S. Appl. No. 10/247,247, Office Action dated May 1, 2008, 7 pages.
U.S. Appl. No. 10/247,247, Office Action dated May 4, 2005, 12 pages.
U.S. Appl. No. 10/247,247, Office Action dated Jul. 19, 2006, 5 pages.
U.S. Appl. No. 10/247,247, Office Action dated Aug. 27, 2003, 10 pages.
U.S. Appl. No. 10/370,545, Notice of Allowance dated Jun. 20, 2006, 6 pages.
U.S. Appl. No. 10/370,545, Office Action dated Jan. 25, 2005, 13 pages.
U.S. Appl. No. 10/370,545, Office Action dated Jan. 26, 2004, 9 pages.
U.S. Appl. No. 10/370,545, Office Action dated Sep. 11, 2003, 12 pages.
U.S. Appl. No. 10/674,739, Office Action dated Dec. 19, 2005, 10 pages.
U.S. Appl. No. 10/674,739, Office Action dated May 18, 2004, 6 pages.
U.S. Appl. No. 10/674,739, Office Action dated May 5, 2006, 7 pages.
U.S. Appl. No. 10/674,739, Office Action dated Aug. 25, 2006, 6 pages.
U.S. Appl. No. 10/674,739, Office Action dated Sep. 30, 2005, 11 pages.
U.S. Appl. No. 10/674,862, Examiner's Answer dated May 15, 2008, 12 pgs.
U.S. Appl. No. 10/674,862, Notice of Allowance dated Aug. 24, 2006, 4 pgs.
U.S. Appl. No. 10/674,862, Office Action dated Aug. 18, 2004, 5 pgs.
U.S. Appl. No. 10/674,862, Office Action dated Dec. 21, 2006, 10 pgs.
U.S. Appl. No. 10/674,862, Office Action dated Mar. 28, 2005, 8 pgs.
U.S. Appl. No. 10/674,862, Office Action dated May 1, 2007, 10 pgs.
U.S. Appl. No. 10/674,862, Office Action dated Oct. 6, 2005, 6 pgs.
U.S. Appl. No. 10/674,862, Office Action dated Sep. 20, 2005, 6 pgs.
U.S. Appl. No. 10/674,862, Official Communication dated May 23, 2008, 2 pgs.
U.S. Appl. No. 10/721,694, Office Action dated Oct. 6, 2005, 11 pages.
U.S. Appl. No. 10/721,694, Office Action dated Mar. 13, 2009, 9 pages.
U.S. Appl. No. 10/721,694, Office Action dated Mar. 24, 2005, 10 pages.
U.S. Appl. No. 10/721,694, Office Action dated Mar. 27, 2007, 9 pages.
U.S. Appl. No. 10/721,694, Office Action dated Apr. 10, 2006, 9 pages.
U.S. Appl. No. 10/721,694, Office Action dated May 18, 2004, 7 pages.
U.S. Appl. No. 10/721,694, Office Action dated Jul. 23, 2004, 6 pages.
U.S. Appl. No. 10/721,694, Office Action dated Aug. 14, 2006, 6 pages.
U.S. Appl. No. 10/721,694, Office Action dated Aug. 27, 2007, 8 pages.
U.S. Appl. No. 10/732,726, Notice of Allowance dated Sep. 20, 2012, 5 pages.
U.S. Appl. No. 10/732,726, Office Action dated Apr. 15, 2010, 16 pgs.
U.S. Appl. No. 10/732,726, Office Action dated Aug. 20, 2008 (Examiner Answer to Appeal Brief), 2 pgs.
U.S. Appl. No. 10/732,726, Office Action dated Dec. 9, 2008, 12 pgs.
U.S. Appl. No. 10/732,726, Office Action dated Jan. 30, 2008 (Examiner Answer to Appeal Brief), 8 pgs.
U.S. Appl. No. 10/732,726, Office Action dated Jun. 2, 2008 (Examiner Answer to Appeal Brief), 2 pgs.
U.S. Appl. No. 10/732,726, Office Action dated Mar. 28, 2005 (Restriction Requirement), 4 pgs.
U.S. Appl. No. 10/732,726, Office Action dated May 1, 2008, 2 pgs.
U.S. Appl. No. 10/732,726, Office Action dated May 19, 2006 (Examiner Answer to Appeal Brief), 9 pgs.
U.S. Appl. No. 10/732,726, Office Action dated May 23, 2005, 10 pgs.
U.S. Appl. No. 10/732,726, Office Action dated May 9, 2011 9 pages.
U.S. Appl. No. 10/732,726, Office Action dated Nov. 16, 2011 9 pages.
U.S. Appl. No. 10/732,726, Office Action dated Nov. 17, 2008 (Dismissal of Appeal), 3 pgs.
U.S. Appl. No. 10/732,726, Office Action dated Oct. 24, 2005, 11 pgs.
U.S. Appl. No. 10/732,726, Office Action dated Oct. 25, 2010, 12 pgs.
U.S. Appl. No. 10/732,726, Office Action dated Sep. 4, 2009, 11 pgs.
U.S. Appl. No. 10/732,726, Office Action dated Sep. 4, 2012, 5 pages.
U.S. Appl. No. 10/738,765, Office Action dated Apr. 13, 2006, 2 pgs.
U.S. Appl. No. 10/738,765, Office Action dated Jan. 13, 2006, 8 pgs.
U.S. Appl. No. 10/738,765, Office Action dated Jun. 6, 2005, 9 pgs.
U.S. Appl. No. 10/738,765, Office Action dated May 22, 2007, 6 pgs.
U.S. Appl. No. 10/738,772, Advisory Action dated May 11, 2006, 3 pgs.
U.S. Appl. No. 10/738,772, Advisory Action dated May 13, 2005, 3 pgs.
U.S. Appl. No. 10/738,772, Notice of Allowance dated Aug. 1, 2006, 5 pages.
U.S. Appl. No. 10/738,772, Notice of Allowance dated Aug. 21, 2006, 1 page.
U.S. Appl. No. 10/738,772, Notice of Allowance dated May 11, 2006, 3 pgs.
U.S. Appl. No. 10/738,772, Notice of Allowance dated Sep. 17, 2004, 8 pgs.
U.S. Appl. No. 10/738,772, Office Action dated May 13, 2005, 3 pgs.
U.S. Appl. No. 10/738,772, Office Action dated Aug. 2, 2005, 9 pgs.
U.S. Appl. No. 10/738,772, Office Action dated Mar. 11, 2005, 10 pgs.
U.S. Appl. No. 10/738,772, Office Action dated Mar. 27, 2006, 6 pgs.
U.S. Appl. No. 10/738,772, Office Action dated Sep. 17, 2004, 9 pgs.
U.S. Appl. No. 10/971,895, Office Action dated Apr. 25, 2007, 8 pgs.
U.S. Appl. No. 10/971,895, Office Action dated Oct. 12, 2007, 9 pgs.
U.S. Appl. No. 11/161,930, Notice of Allowance dated Sep. 15, 2008, 6 pgs.
U.S. Appl. No. 11/161,930, Office Action dated Feb. 20, 2008, 6 pages.
U.S. Appl. No. 11/161,933, Notice of Allowance dated Jan. 29, 2009, 6 pgs.
U.S. Appl. No. 11/161,933, Office Action dated Jun. 23, 2008, 7 pgs.
U.S. Appl. No. 11/423,996, Office Action dated Dec. 5, 2006, 9 pages.
U.S. Appl. No. 11/423,996, Office Action dated Apr. 16, 2007, 13 pages.
U.S. Appl. No. 11/423,996, Office Action dated Jul. 7, 2006, 9 pages.

(56) References Cited

OTHER PUBLICATIONS

U.S. Appl. No. 11/873,200 entitled "Shower Station Testing Assembly for Pressure Testing Plumbing", by Wiliam T. Ball, filed Oct. 16, 2007, 24 pages.
U.S. Appl. No. 11/931,681, Notice of Allowance dated Aug. 4, 2011 8 pages.
U.S. Appl. No. 11/931,681, Office Action dated Apr. 26, 2011 15 pages.
U.S. Appl. No. 12/057,660, Notice of Allowance for dated Mar. 7, 2012 5 pages.
U.S. Appl. No. 12/057,660, Office Action dated Nov. 3, 2011 9 pages.
U.S. Appl. No. 12/100,762, Office Action dated Jan. 31, 2014, 10 pages.
U.S. Appl. No. 12/100,762, Office Action dated Feb. 1, 2012, 9 pages.
U.S. Appl. No. 12/100,762, Office Action dated Aug. 13, 2014 9 pages.
U.S. Appl. No. 12/100,762, Office Action dated Sep. 15, 2011 9 pages.
U.S. Appl. No. 12/405,956, Office Action dated Oct. 14, 2010, 8 pages.
U.S. Appl. No. 12/896,137, Notice of Allowance dated May 15, 2014, 5 pages.
U.S. Appl. No. 12/896,137, Office Action dated Feb. 24, 2014, 6 pages.
U.S. Appl. No. 12/896,137, Office Action dated Sep. 5, 2013, 10 pages.
U.S. Appl. No. 13/041,929, Notice of Allowance dated Feb. 11, 2015 7 pages.
U.S. Appl. No. 13/041,929, Notice of Allowance dated Mar. 11, 2015 4 pages.
U.S. Appl. No. 13/041,929, Notice of Allowance dated Mar. 31, 2015 4 pages.
U.S. Appl. No. 13/041,929, Office Action dated Dec. 18, 2013 (Restriction Requirement), 6 pages.
U.S. Appl. No. 13/041,929, Office Action dated May 8, 2014 12 pages.
U.S. Appl. No. 13/234,030, Notice of Allowance dated Oct. 19, 2012 5 pages.
U.S. Appl. No. 13/234,030, Office Action dated Apr. 12, 2012, 15 pages.
U.S. Appl. No. 13/234,030, Office Action dated Aug. 7, 2012 13 pages.
U.S. Appl. No. 13/274,804, Notice of Allowance dated Apr. 23, 2014, 6 pages.
U.S. Appl. No. 13/274,804, Office Action dated Dec. 24, 2013, 10 pages.
U.S. Appl. No. 13/461,422, Notice of Allowance dated Apr. 18, 2013, 6 pages.
U.S. Appl. No. 13/461,422, Office Action dated Dec. 27, 2012 9 pages.
U.S. Appl. No. 13/669,417, Notice of Allowance dated Nov. 15, 2013, 5 pgs.
U.S. Appl. No. 13/669,417, Notice of Allowance dated Sep. 27, 2013, 9 pgs. 9 pages.
U.S. Appl. No. 13/669,417, Office Action dated Mar. 1, 2013, 7 pgs. 12 pages.
U.S. Appl. No. 13/691,405, Notice of Allowance dated Oct. 9, 2013, 7 pages.
U.S. Appl. No. 13/691,405, Office Action dated Aug. 14, 2013, 5 pages.
U.S. Appl. No. 13/726,840, Notice of Allowance dated Apr. 27, 2015, 7 pages.
U.S. Appl. No. 13/894,626, Notice of Allowance dated Aug. 10, 2015 5 pages.
U.S. Appl. No. 13/894,626, Notice of Allowance dated Oct. 29, 2015 4 pages.
U.S. Appl. No. 13/894,626, Office Action dated Jul. 16, 2015 7 pages.
U.S. Appl. No. 13/974,690, Notice of Allowance dated Jun. 15, 2015, 5 pages.
U.S. Appl. No. 13/974,690, Office Action dated Apr. 22, 2015, 9 pages.
U.S. Appl. No. 14/074,442, Office Action dated Oct. 7, 2015, 12 pages.
U.S. Appl. No. 14/074,442, Office Action dated Feb. 12, 2016, 13 pages.
U.S. Appl. No. 14/109,503, Notice of Allowance dated Mar. 11, 2015, 8 pages.
U.S. Appl. No. 14/109,503, Office Action dated Aug. 18, 2014, 6 pages.
U.S. Appl. No. 14/109,503, Office Action dated Dec. 29, 2014, 10 pages.
U.S. Appl. No. 14/618,594, Office Action dated Feb. 11, 2016, 14 pages.
U.S. Appl. No. 14/618,594, Office Action dated May 22, 2015, 13 pages.
U.S. Appl. No. 14/701,091, Notice of Allowance dated Oct. 29, 2015, 5 pages.
U.S. Appl. No. 14/701,091, Office Action dated Oct. 15, 2015, 8 pages.
U.S. Appl. No. 14/701,091, Office Action dated Jul. 15, 2015, 7 pages.
U.S. Appl. No. 14/710,351, Notice of Allowance dated Jan. 30, 2017, 7 pages.
U.S. Appl. No. 14/710,351, Office Action dated Dec. 16, 2016, 7 pages.
U.S. Appl. No. 15/596,582, Office Action dated Jul. 18, 2018, 7 pages.
U.S. Appl. No. 15/597,691, Office Action dated Oct. 5, 2018, 11 pages.
U.S. Appl. No. 15/675,306, Office Action dated Aug. 8, 2018, 12 pages.
U.S. Appl. No. 29/360,523, Corrected Notice of Allowance dated Mar. 16, 2011 3 pages.
U.S. Appl. No. 29/360,523, Notice of Allowability dated Jan. 11, 2011, 4 pgs.
U.S. Appl. No. 29/360,523, Office Action for dated Oct. 5, 2010, 8pgs.
U.S. Appl. No. 29/360,523, Office Action dated Dec. 23, 2010, 6pgs.
U.S. Appl. No. 29/360,524, Notice of Allowability dated Oct. 7, 2010, 11 pgs.
U.S. Appl. No. 29/362,288, Notice of Allowability dated Oct. 7, 2010, 8pgs.
U.S. Appl. No. 29/378,602, Notice of Allowance dated Jun. 21, 2012 7 pages.
U.S. Appl. No. 29/378,602, Office Action dated Mar. 9, 2012 6 pages (Restriction Requirement).
U.S. Appl. No. 29/378,602, Office Action dated Mar. 27, 2012 5 pages.
U.S. Appl. No. 29/396,333, Notice of Allowance dated Nov. 5, 2012, 7 pages.
U.S. Appl. No. 29/396,333, Office Action dated Jul. 31, 2012, 6 pgs.
U.S. Appl. No. 29/396,333, Supplemental Notice of Allowance dated Dec. 6, 2012, 4 pages.
U.S. Appl. No. 29/484,008, Notice of Allowance dated Jan. 2, 2015, 9 pages.
U.S. Appl. No. 13/456,017, Notice of Allowance dated Feb. 4, 2015, 6 pgs.
U.S. Appl. No. 15/596,582, Notice of Allowance dated Feb. 4, 2019, 7 pages.
U.S. Appl. No. 15/675,306, Office Action dated Mar. 8, 2019, 14 pages.
U.S. Appl. No. 15/597,691, Office Action dated Apr. 19, 2019, 11 pages.
U.S. Appl. No. 15/675,306, Notice of Allowance dated May 30, 2019, 7 pages.
U.S. Appl. No. 15/675,306, Notice of Allowance dated Jun. 19, 2019, 4 pages.
U.S. Appl. No. 15/675,306, Notice of Allowance dated Sep. 6, 2019, 4 pages.

(56) References Cited

OTHER PUBLICATIONS

U.S. Appl. No. 15/597,691, Notice of Allowance dated Oct. 2, 2019, 9 pages.
U.S. Appl. No. 16/450,548, Office Action dated Sep. 21, 2020, 9 pages.
U.S. Appl. No. 15/597,691 Notice of Allowance dated Jan. 15, 2020, 5 pages.
U.S. Appl. No. 16/750,986, Office Action dated Mar. 10, 2021, 12 pages.
U.S. Appl. No. 16/750,986, Notice of Allowance dated Jun. 16, 2021, 8 pages.

* cited by examiner

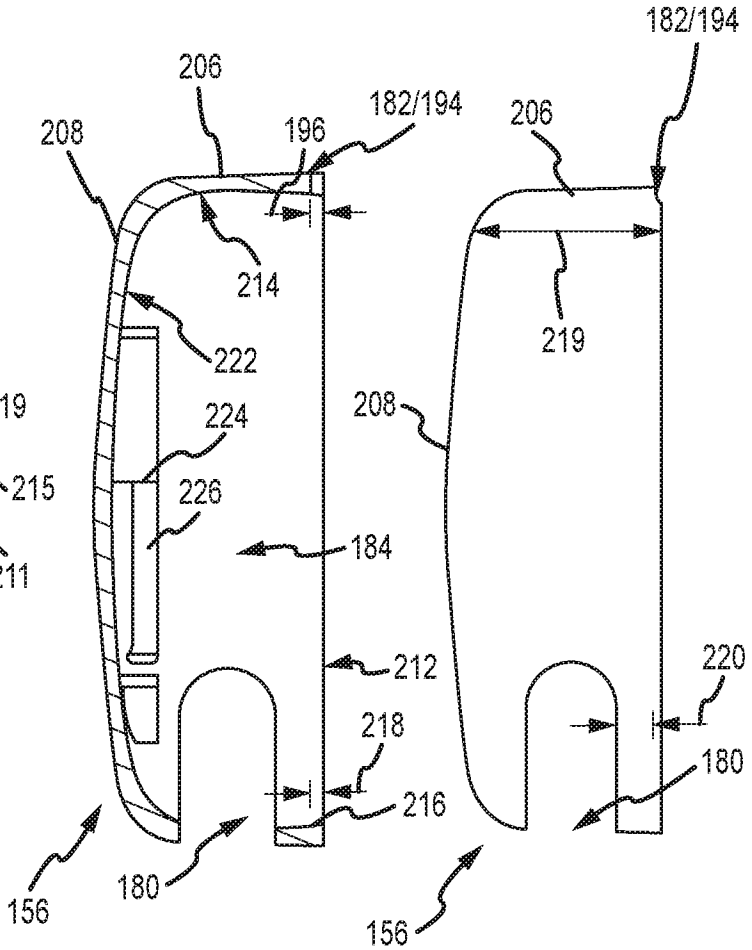
FIG.5D
FIG.5E
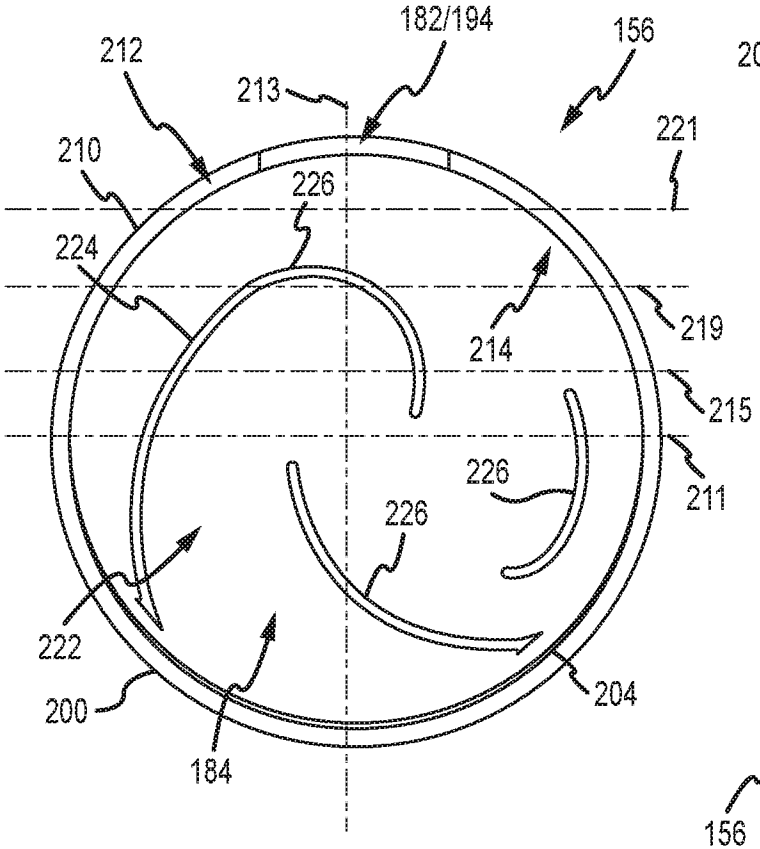
FIG.5F

DEVICE FOR PROVIDING IMPROVED DRAINAGE

CROSS-REFERENCE TO RELATED APPLICATIONS

This application is a continuation of U.S. patent application Ser. No. 15/675,306, filed Aug. 11, 2017, now Issued U.S. Pat. No. 10,443,220, issued Oct. 15, 2019, which claims priority to and the benefit of U.S. Provisional Patent Application Ser. No. 62/374,089, filed on Aug. 12, 2016, under 35 U.S.C. § 119(e), the disclosures of which are herein by incorporated herein by reference in their entirety.

INTRODUCTION

A bathtub generally has a drain system positioned in a bottom of the bathtub that allows for selective opening and closing so that the bathtub can retain water. Additionally, an overflow system is provided so that once the water within the bathtub reaches a predetermined height the water can drain from the bathtub and reduce or prevent water from overflowing the bathtub and flowing onto the floor. The overflow system interconnects the bathtub's overflow port to a wastewater system and includes an opening that enables water to flow from the bathtub to the wastewater system. In some known overflow systems exit flow from the opening can be reduced or completely restricted because air pressure within the overflow system restricts or even prevents the water from entering the opening.

SUMMARY

In one aspect, the technology relates to an overflow assembly for a bathtub including: an elbow including a first threaded section; a retainer nut including a second corresponding threaded section, wherein the retainer nut is configured to threadably mount onto the elbow; and an overflow cover including at least one overflow opening and at least one vent opening defined therein, wherein the overflow cover is configured to engage with the retainer nut and substantially cover the first threaded section and the retainer nut.

In an example, the at least one vent opening is configured to equalize air pressure inside the elbow with air pressure outside of the overflow assembly and increase a flow rate of a liquid through the at least one overflow opening. In another example, the overflow cover includes: a face; and an exterior wall extending from the face, wherein the exterior wall is sized and shaped to receive the retainer nut, and wherein an end of the exterior wall defines a mounting surface that is positionable at least partially against the bathtub when the overflow cover is engaged with the retainer nut. In yet another example, the at least one vent opening is at least partially defined by the exterior wall. In still another example, the at least one vent opening is only partially defined by the exterior wall. In an example, the at least one vent opening is completely defined by the exterior wall. In another example, the retainer nut further includes a plurality of circumferentially spaced and radially extending lugs, wherein the exterior wall has a projection configured to frictionally engage with the plurality of lugs, and wherein the at least one vent opening has a length greater than a length of a lug of the plurality of lugs. In yet another example, the overflow cover includes an interior surface having at least one surface feature configured to increase a flow rate of a liquid through the overflow assembly.

In another aspect, the technology relates to an overflow assembly for a bathtub including: an elbow; a retainer nut; a bracket configured to secure the retainer nut to the elbow; and an overflow cover including at least one overflow opening and at least one vent opening defined therein, wherein the overflow cover is configured to engage with the retainer nut and substantially cover the bracket and the retainer nut.

In another aspect, the technology relates to an overflow cover including: a face; and an exterior wall extending from the face, wherein the exterior wall is sized and shaped to receive and engage a retainer nut of an overflow assembly, wherein an end of the exterior wall defines a mounting surface that is configured to be positioned against a bathtub when the overflow cover is mounted over an overflow port, and wherein at least one overflow opening and at least one vent opening are at least partially defined by the exterior wall.

In an example, the at least one vent opening is only partially defined by the exterior wall. In another example, the exterior wall includes an interior surface having a projection extending therefrom, the projection is offset from the mounting surface and configured to frictionally engage a retainer nut, and wherein the at least one vent opening extends from the mounting surface to a depth that is less than or equal to the offset distance. In yet another example, the at least one vent opening is completely defined by the exterior wall. In still another example, the exterior wall includes an interior surface having a projection extending therefrom, the projection is offset a distance from the mounting surface and configured to frictionally engage a retainer nut, and wherein the at least one vent opening is positioned between the projection and the face. In an example, the face includes an interior surface having at least one surface feature configured to increase a flow rate of a liquid through the overflow assembly. In another example, the at least one surface feature includes at least one fin extending from the interior surface. In yet another example, the at least one surface features includes a textured surface. In still another example, the exterior wall defines a length, and wherein the at least one overflow opening is offset along the length from the at least one vent opening. In an example, the at least one overflow opening is positioned below a horizontal centerline of the overflow cover, and wherein the at least one vent opening is positioned above the horizontal centerline. In another example, the at least one vent opening is substantially disposed opposite the at least one overflow opening.

These and various other features as well as advantages which characterize the overflow assembly and overflow cover described herein will be apparent from a reading of the following detailed description and a review of the associated drawings. Additional features are set forth in the description which follows, and in part will be apparent from the description, or may be learned by practice of the technology. The benefits and features of the technology will be realized and attained by the structure particularly pointed out in the written description and claims hereof as well as the appended drawings.

It is to be understood that both the foregoing introduction and the following detailed description are exemplary and explanatory and are intended to provide further explanation of the invention as claimed.

BRIEF DESCRIPTION OF THE DRAWINGS

The following drawing figures, which form a part of this application, are illustrative of described technology and are not meant to limit the scope of the invention as claimed in any manner, which scope shall be based on the claims appended hereto.

FIGS. 5A-5F are perspective, top, bottom, side, cross-sectional, and interior views, respectively, of an exemplary overflow cover.

DETAILED DESCRIPTION

Before the overflow assembly and overflow cover that are the subject of this disclosure are described, it is to be understood that this disclosure is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting. It must be noted that, as used in this specification, the singular forms "a," "an," and "the" include plural referents unless the context clearly dictates otherwise.

This disclosure describes overflow covers for use in an overflow assembly of a bathtub. The overflow covers enable a flow rate of water exiting from the bathtub to be increased and to reduce flow rate restriction due to the buildup of air pressure within the overflow assembly. The overflow covers include an overflow opening and a vent opening so that the air pressure from inside the overflow assembly is allowed to equalize with the air pressure outside of the overflow assembly without having to escape from the overflow opening. Additionally, the overflow cover may include an interior surface feature that further increases the flow rate of the water exiting from the bathtub.

Figure 1:
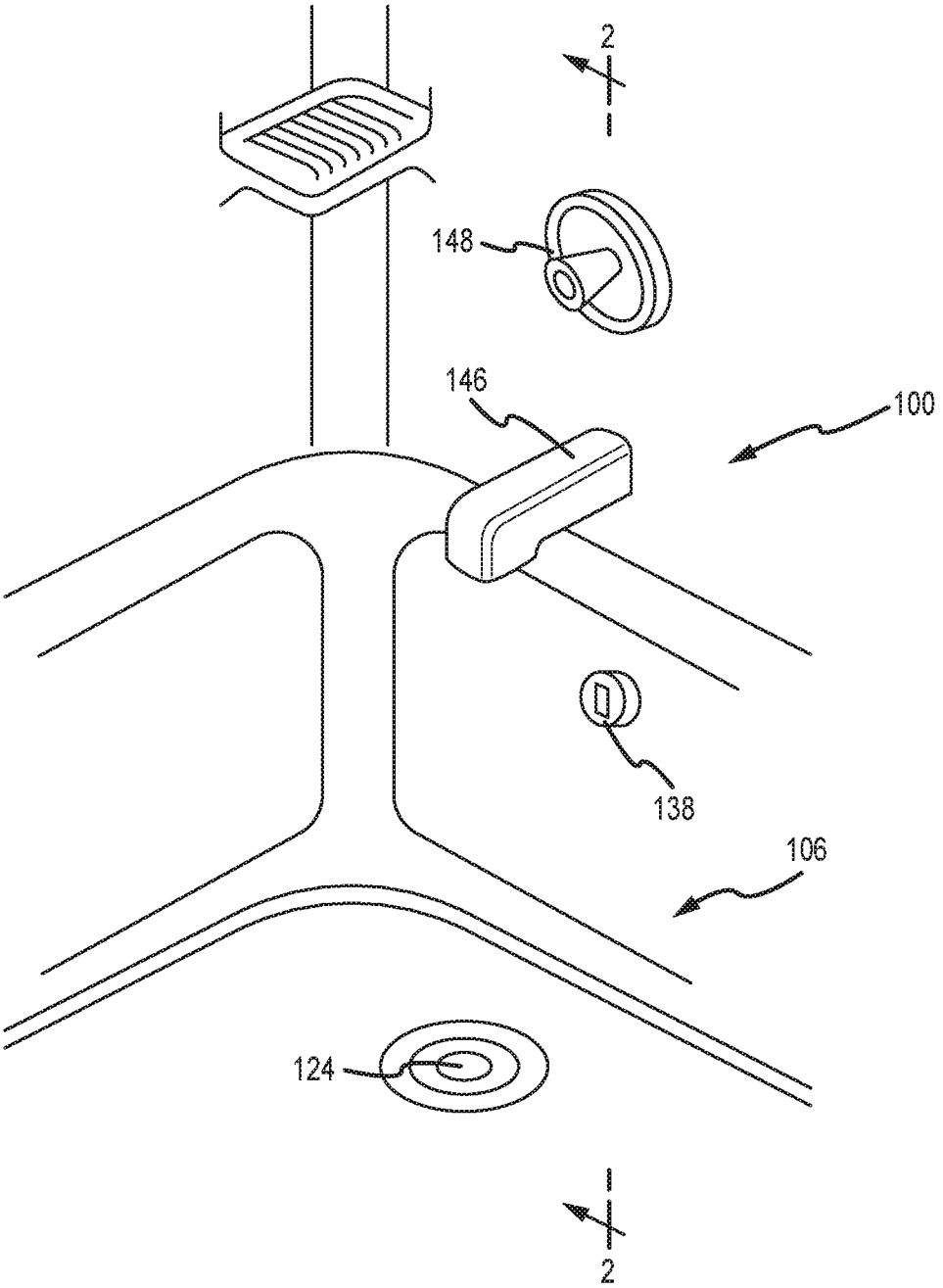
FIG. 1 is a partial perspective view of an exemplary bathroom structure.
Figure 2:
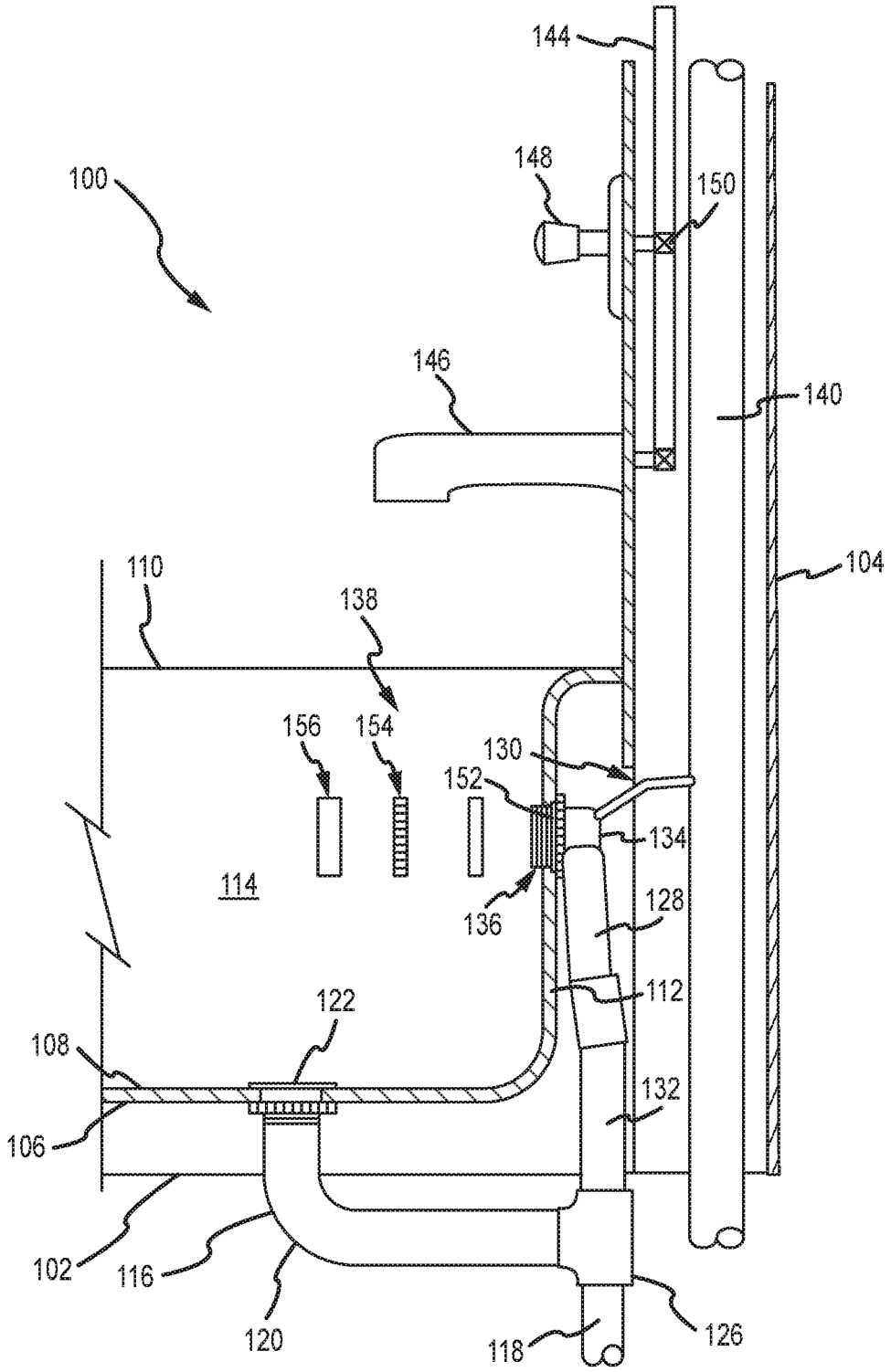
FIG. 2 is a cross-sectional view of the bathroom structure shown in FIG. 1 taken along line 2-2.

FIG. 1 is a partial perspective view of an exemplary bathroom structure 100. FIG. 2 is a cross-sectional view of the bathroom structure 100 taken along line 2-2 (shown in FIG. 1). Referring concurrently to FIGS. 1 and 2, the bathroom structure 100 includes a floor 102 and at least one wall 104 with a bathtub 106 positioned therein and supported on the floor 102. The bathtub 106 includes a bottom 108 with side walls 110 and end walls 112 extending upwardly therefrom and which form an open basin 114 that may retain liquid, such as water, therein. A drain system 116 couples the bathtub 106 in flow communication with a wastewater plumbing system 118 to enable the water to be drained from the bathtub 106 and channeled out of the bathroom structure 100. The drain system 116 may include a drain elbow 120 that is attached at a first end to the bottom 108 of the bathtub 106 at a drain port 122. A tub closure assembly 124 is coupled to the first end of the drain elbow 120 and enables the drain port 122 to be selectively opened and closed. From the bathtub 106, the drain elbow 120 extends to a T-connector 126 which couples the drain elbow 120 to the plumbing system 118.

In addition to the drain system 116, an overflow system 128 also couples the bathtub 106 in flow communication with the plumbing system 118 to enable water to be drained from the bathtub 106 at a second location within the bathtub and channeled out of the bathroom structure 100. The overflow system 128 may be positioned within a wall opening 130 defined in the wall 104 and include an overflow pipe 132 that is attached at a first end, via an overflow elbow 134, to the end wall 112 at an overflow port 136. An overflow assembly 138 is coupled to the first end of the overflow elbow 134 and provides a covering for the overflow port 136. From the bathtub 106, the overflow pipe 132 extends to the T-connector 126 which couples the overflow pipe 132 to the plumbing system 118. The overflow pipe 132 can be either a rigid pipe member, with or without fittings, or a flexible pipe member. A vent pipe 140 runs within the wall 104 and is open to exterior ambient air at one end to provide venting of the plumbing system 118. Additionally, one or more water supply lines 144 run within the wall 104 and are in flow communication with a faucet 146 positioned proximate the bathtub 106 and/or a shower head (not shown) positioned above the bathtub 106. A control assembly 148 mounted on the wall 104 includes one or more control valves 150 that are used to control the flow and/or temperature of the water from the valves 150 to the faucet 146 and/or shower head.

In operation, a flow of water, for example, from the faucet 146, may be used to fill the bathtub 106. Water flow out of the bathtub 106 may be impeded for a number of reasons. For example, the tub closure assembly 124 may be closed to prevent water from draining out of the bathtub 106 through the drain system 116. Also, at times the drain elbow 120 may be clogged, preventing water from draining out of the bathtub 106. Regardless, to reduce or eliminate overflow from the bathtub 106, the overflow system 128 is used to enable the water to flow out of the open basin 114 and into the plumbing system 118 once the water reaches the installation height of the overflow assembly 138. The exit flow rate of the overflow system 128 in relation to the inlet flow rate from the faucet 146 determines how long it takes to overflow the bathtub 106. In examples, the overflow system 128 may be sized and shaped to have an exit flow rate less than, equal to, or greater than the inlet flow from the faucet 146.

Figure 3:
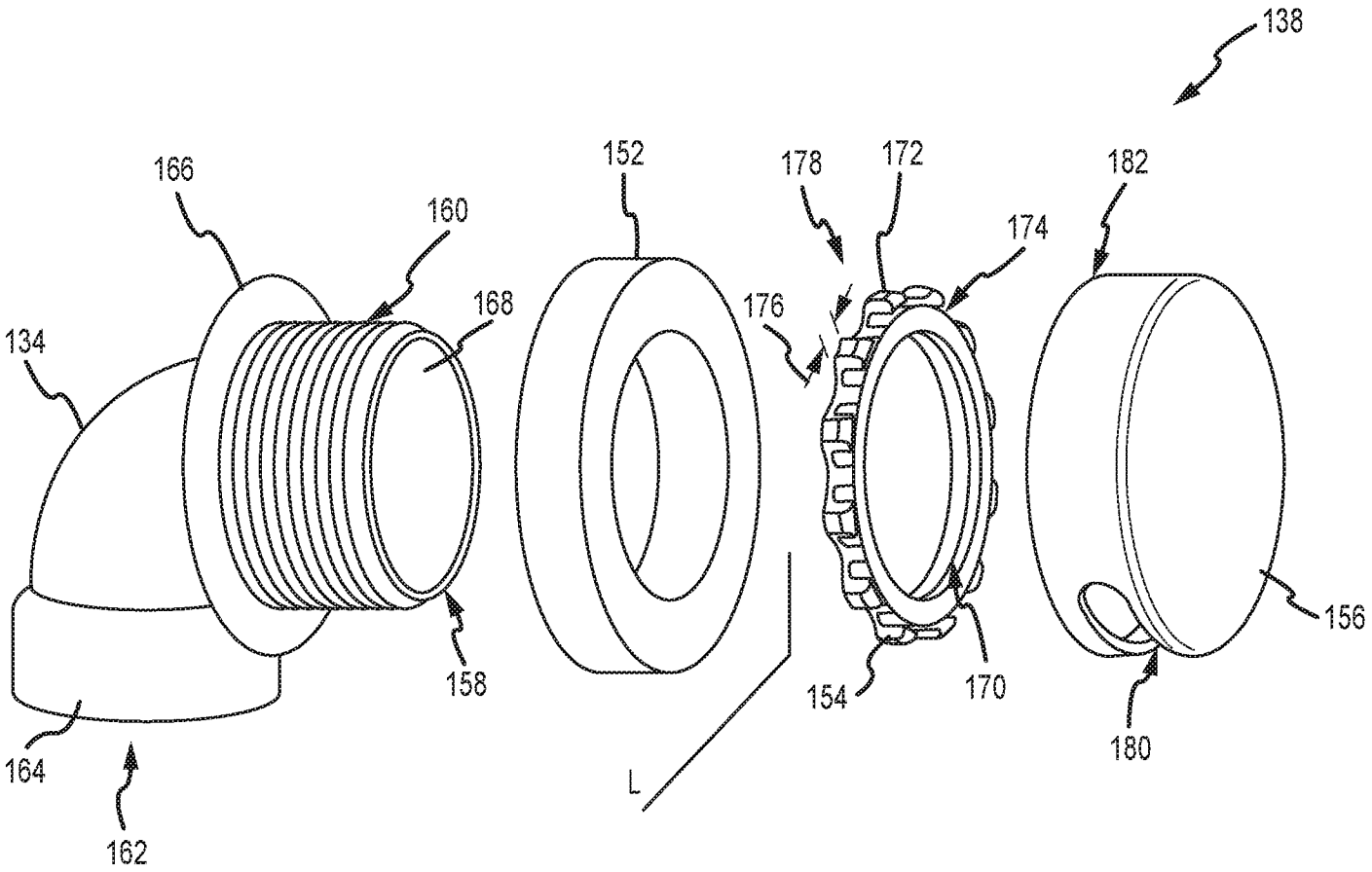
FIG. 3 is an exploded perspective view of an exemplary overflow assembly shown in FIG. 2.

When the water reaches the level of the overflow assembly and/or submerges the overflow assembly, the upstream water within the bathtub may cavitate and/or form a funnel flow such that the air pressure from inside the overflow assembly is allowed to equalize with the air pressure outside of the overflow assembly and allow the exit flow from the bathtub through at least one overflow opening 180 (shown in FIG. 3). However, in some known systems, when water reaches the level of the overflow assembly and/or submerges the overflow assembly, upstream water cavitation and/or funnel flow is reduced and/or restricted, thereby reducing or completely restricting the exit flow because downstream air pressure within the overflow elbow is not allowed to equalize. This cavitation may create a boundary that prevents water from entering the overflow assembly. As such, water can more quickly overflow the bathtub. In examples, if the upstream water within the bathtub has a more turbulent flow proximate to the overflow assembly, cavitation and/or funnel flow formation within the water is reduced. The turbulent flow may be induced within the upstream bathtub water by the inlet flow rate from the faucet, pressure of the inlet flow, distance (height and length) from the faucet to the overflow assembly, and/or distance from the faucet to the water level in the bathtub.

Accordingly, the overflow assembly 138 includes at least one vent opening 182 (shown in FIG. 3) so that the air pressure from inside the overflow assembly can equalize with the air pressure outside of the overflow assembly without having to escape from the overflow opening. As such, the exit flow rate through the overflow assembly 138 may be increased during overflow conditions. Additionally, exit flow through the overflow assembly 138 during upstream turbulent flow of the bathtub water is enabled and increased. In the example, the overflow assembly 138 includes the overflow elbow 134, a seal 152, a retainer nut 154, and an overflow cover 156 that is also sometimes referred to as a face plate, a cap, a plate, and/or an overflow plate. The overflow assembly 138 is described further below in reference to FIGS. 3-5F. Additionally, components of the bathroom structure 100 are further described in, for example, U.S. Pat. No. 8,321,970 entitled "METHOD AND ASSOCIATED APPARATUS FOR ASSEMBLY AND TESTING A PLUMBING SYSTEM," and U.S. Pat. No. 9,200,436 entitled "OVERFLOW ASSEMBLY FOR BATHTUBS AND THE LIKE," both of which are incorporated herein by reference in their entireties.

FIG. 3 is an exploded perspective view of the overflow assembly 138. The overflow assembly 138 includes the overflow elbow 134 that acts as an inlet fitting for the overflow pipe 132 (shown in FIG. 2). The elbow 134 includes an inlet end 158 having a threaded outer surface 160 and an outlet end 162 having a collar 164 so that the elbow 134 may be coupled to the overflow pipe as described above. The inlet end 158 is disposed at an angle in relation to the inlet end 158 and is sized and shaped to extend through the overflow port of the bathtub. A radial flange 166 is adjacent to the threaded outer surface 160 at the inlet end 158 so that only the threaded outer surface 160 of the inlet end 158 extends through the overflow port. In some examples, a thin membrane 168 may cover the inlet end 158 of the elbow 134 to facilitate bathtub leak testing as described in U.S. Pat. No. 9,200,436 entitled "OVERFLOW ASSEMBLY FOR BATHTUBS AND THE LIKE." Once testing is completed, the membrane 168 may be removed to enable operation of the overflow assembly as described above.

The overflow assembly 138 also includes the seal 152 which can be formed out of a foam or rubber compound. The seal 152 is positioned between the radial flange 166 of the elbow 134 and the outside of the bathtub end wall (depicted schematically at line L) and is flexible to facilitate alignment and securement of the overflow assembly 138. The retainer nut 154 includes a threaded inner surface 170 that corresponds to and is compatible with the threaded outer surface 160 of the elbow 134 so that the retainer nut 154 may threadably mount onto the elbow 134. A plurality of circumferentially spaced and radially extending lugs 172 extend from an outer surface 174 of the retainer nut 154. Each lug 172 has a circumferential length 176 and is separated from one another by a gap 178. When the retainer nut 154 engages the overflow elbow 134, the bathtub wall and the seal 152 are compressed between the radial flange 166 and the retainer nut 154 so as to secure the overflow assembly 138 within the overflow port. In alternative examples, the retainer nut 154 may be any other type of fastener, for example, a slip nut that enables the overflow assembly 138 to be secured within the bathtub as described herein.

The overflow cover 156 is configured to selectively engage with the retainer nut 154 and conceal the inlet end 158 of the elbow 134 and the retainer nut 154 such that a finish is provided with no visible fastening hardware. The overflow cover 156 includes at least one overflow opening 180 and at least one vent opening 182 at least partially defined therein. The overflow opening 180 enables water to flow into the overflow elbow 134 from the bathtub. The vent opening 182 enables the air pressure inside the elbow 134 to equalize with the air pressure outside of the overflow assembly 138 so that the flow rate of water through the overflow opening 180 is increased, thereby reducing water overflowing the bathtub and onto the floor. The overflow cover 156 is described further below in reference to FIGS. 5A-5F.

Figure 4A:
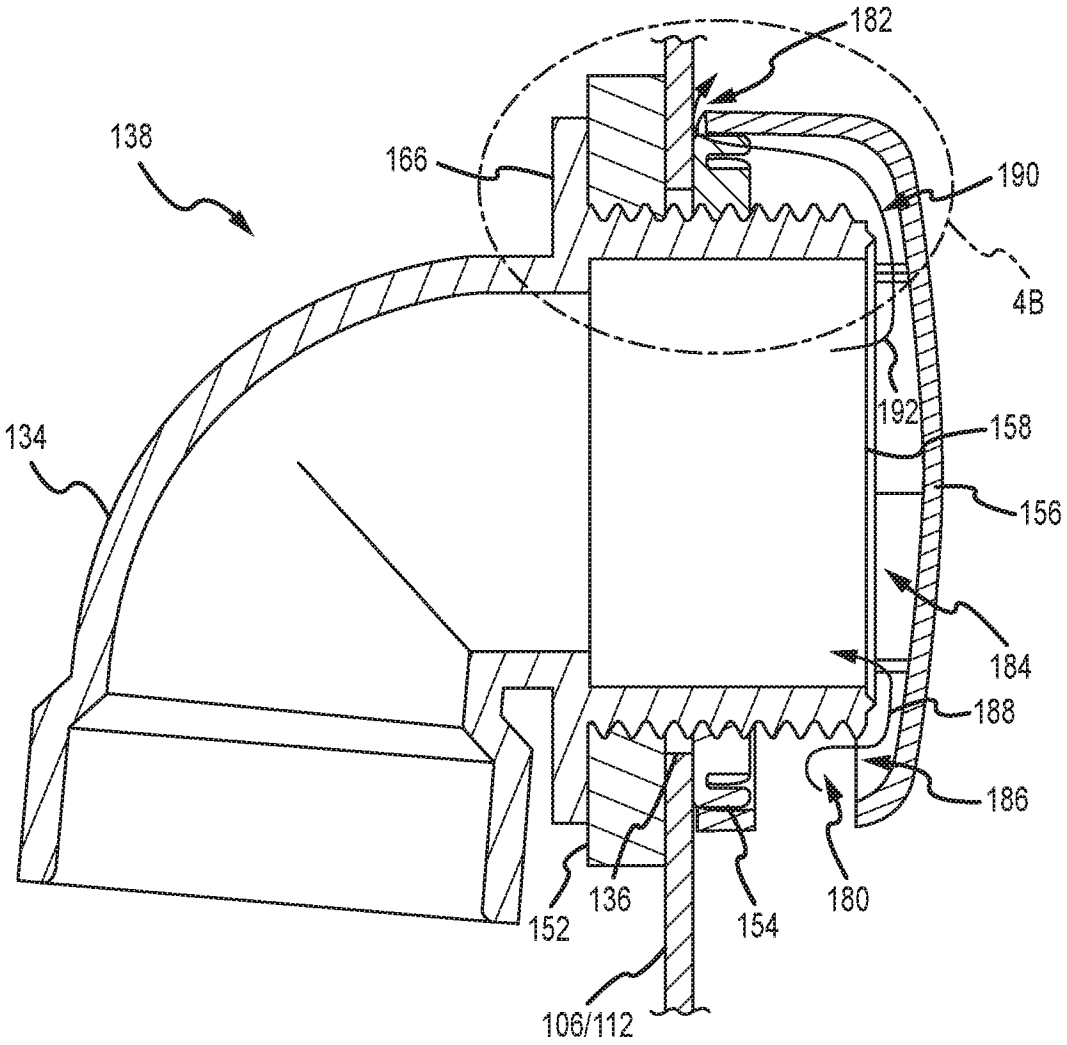
FIG. 4A is a cross-sectional view of the overflow assembly shown in FIG. 2 installed within a bathtub overflow port.
Figure 4B:
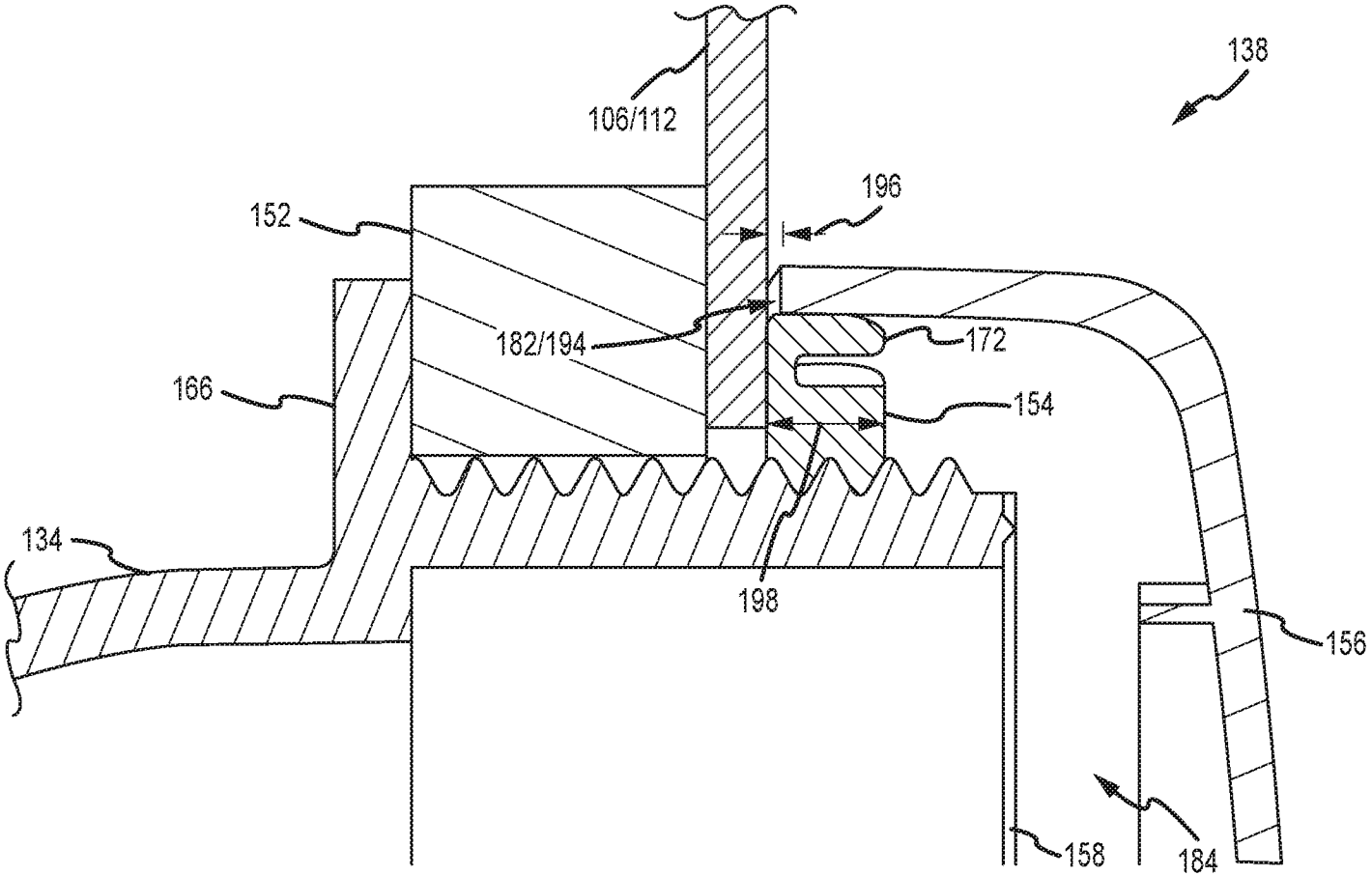
FIG. 4B is a detail view of the overflow assembly shown in FIG. 4A taken at 4B.
Figure 5A:
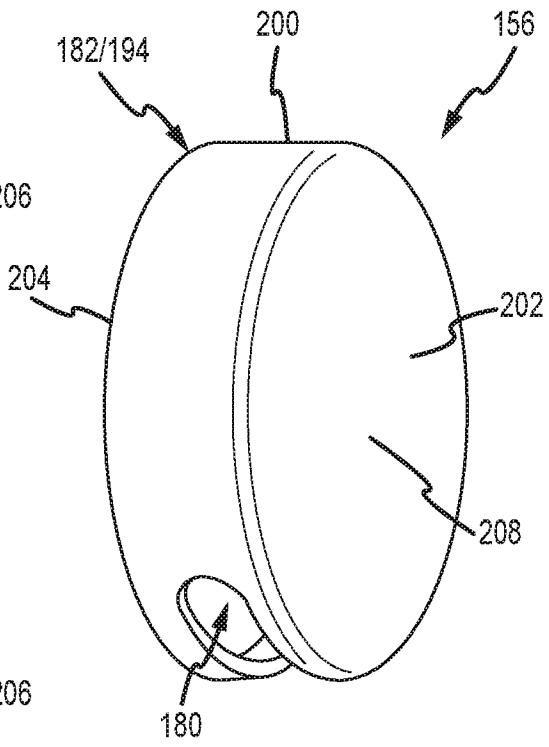
Figure 5B:
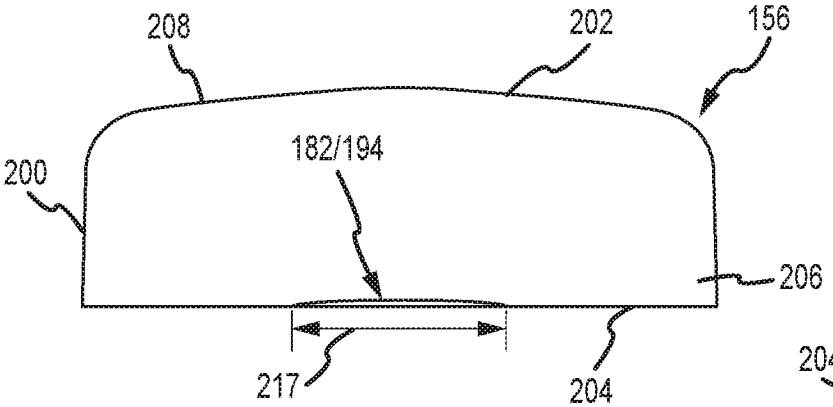
Figure 5C:
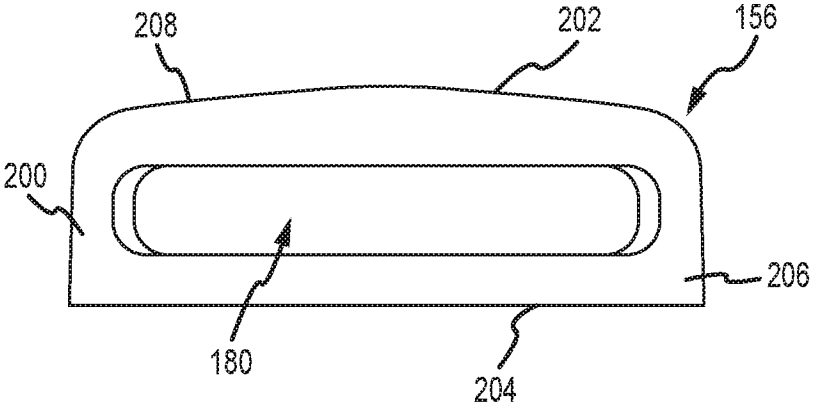

FIG. 4A is a cross-sectional view of the overflow assembly 138 installed within the bathtub overflow port 136. FIG. 4B is a detail view of the overflow assembly 138 taken at 4B (shown in FIG. 4A). Referring concurrently to FIGS. 4A and 4B, the inlet end 158 of the overflow elbow 134 extends through the overflow port 136 defined in the end wall 112 of the bathtub 106. The retainer nut 154 may threadingly engage with the inlet end 158 so that the seal 152 and the bathtub 106 are compressed between the retainer nut 154 and the radial flange 166 of the elbow 134 and the overflow assembly 138 is secured to the bathtub 106. Once the retainer nut 154 secures the elbow 134 to the bathtub, the overflow cover 156 may be selectively engaged onto the retainer nut 154 so as secure the overflow cover 156 around the overflow port 136 and the inlet end 158 with no visible mounting fastening hardware.

The overflow cover 156 defines an interior chamber 184 that is sized and shaped so a first channel 186 may be defined between the elbow 134 and the overflow cover 156. The first channel 186 extends from the overflow opening 180, which is positioned at the bottom of the cover 156 when it is engaged with the retainer nut 154, to the inlet end 158 so that water may flow (illustrated with arrow 188) from the bathtub 106 and into the overflow assembly 138 thereby reducing or eliminating bathtub overflow. Additionally, the interior chamber 184 of the overflow cover 156 is sized and shaped so a second channel 190 may be defined between the elbow 134 and the overflow cover 156. The second channel 190 extends from the vent opening 182, which is positioned at the top of the cover 156 when it is engaged with the retainer nut 154, to the inlet end 158 so that air may flow (illustrated with arrow 192) out of the overflow assembly 138. As such, during water inflow 188, the air pressure from inside the overflow system 128 is allowed to equalize with the air pressure outside of the overflow system 128, thereby increasing the exit flow rate of the water through the overflow opening 180.

In the example, the overflow cover 156 has at least one recess 194 defined therein so that the vent opening 182 is formed between the bathtub 106 and the overflow cover 156 when the overflow cover 156 is engaged with the retainer nut 154. The recess 194 has a depth 196 that is less than a thickness 198 of the retainer nut 154 such that at least one lug 172 of the retainer nut 154 is positioned within the vent opening 182. However, the recess 194 has a circumferential length 217 (shown in FIG. 5B) that is greater than the circumferential length 176 (shown in FIG. 3) of each lug 172, so that air can flow 192 through the vent opening 182 and within the gaps between each lug 172. As such, the vent opening 182 cannot be fully blocked no matter what position the retainer nut 154 is in when the overflow cover 156 is engaged. Additionally, the lugs 172 are partially spaced apart from the outer surface of the retainer nut so that air flow may flow around the lugs.

FIGS. 5A-5F are perspective, top, bottom, side, cross-sectional, and interior views, respectively, of an exemplary overflow cover 156. In general, orientations of the overflow cover 156 are described as depicted in the figures (e.g., top, bottom, interior, etc.). These general terms are utilized for clarity only to distinguish the various orientations from each other with respect to the intended installation orientation of the overflow cover 156 within the bathtub as shown in FIGS. 4A and 4B. In the example, the overflow cover 156 is formed from a cylindrical body 200 that includes a first end 202, an opposite second end 204, with an exterior wall 206 axially extending between the first end 202 and the second end 204. The first end 202 is enclosed with a face 208 and the exterior wall 206 extends from the face 208. In the example, the face 208 does not have any mounting holes defined therein. As such, the overflow cover 156 frictionally engages with the lugs on the retainer nut so as to mount within the bathtub. In other examples, the face may include at least one mounting hole so that the overflow cover 156 may mount to the overflow elbow with one or more fasteners. As used herein the vent opening 180 is distinct and different from the mounting holes that may be used to fasten an overflow cover to the overflow elbow and that, when installed, would be filled with a screw or other fastener. The vent opening 180 is configured to be left substantially open when installed to provide the venting described herein.

The second end 204 is defined at the end of the exterior wall 208. At the second end 204 the exterior wall 208 open and is sized and shaped to receive the retainer nut as described above. A perimeter 210 of the exterior wall 208 defines a mounting surface 212 that is positionable at least partially against the bathtub when the overflow cover 156 engages with the retainer nut. In some embodiments, the body 200 may be formed as any other shape as required or desired such as square, rectangular, triangular, and cowbell-shaped. In other embodiments, the face 208 may extend radially outward from the exterior wall 206 such that a lip is formed at the first end 202.

The at least one overflow opening 180 is completely defined by the exterior wall 206 between the first end 202 and the second end 204. In the example, the overflow opening 180 is a single opening positioned at the bottom of the overflow cover 156 so that as the water rises within the bathtub, the overflow opening 180 enables the water to exit out of the bathtub and reduce overflowing the bathtub. The overflow cover 156 may be defined by a horizontal centerline 211 that substantially divides the body 200 between an upper half and a lower half of the body in its intended installation position. Although FIG. 5F illustrates a substantially circular profile of the body 200 in an exemplary installed position, as discussed, the shape of the body 200 can take many forms. As used herein, regardless of the shape of the body 200, the horizontal centerline 211 is located approximately at the mid-point between the top most surface of the body 200 and the bottom most surface of the body 200 in its intended installation position. The overflow cover 156 may also define a vertical centerline 213 that divides the body 200 between a right side and a left side of the body in its intended installation position. The vertical centerline 213 is located approximately at the mid-point between the right most surface of the body 200 and the left most surface of the body 200. The overflow opening 180 may be positioned below the horizontal centerline 211 and centered about the vertical centerline 213 at the bottom most surface of the body, which may be referred to as a 6 o'clock position. In examples, the overflow opening 180 is so positioned when installed so that the rising water in a bathtub reaches the overflow opening 180 most quickly; however, the overflow opening 180 can be configured in a variety of positions about the body. For example, the overflow opening 180 may be positioned at any location below the horizontal centerline 211 and offset from the vertical centerline 213. For example, the overflow opening position may be between a 3 o'clock position and a 9 o'clock position. In yet other examples, the overflow opening may include a plurality of discrete openings all completely defined by the exterior wall. In alternative examples, the overflow opening may be only partially defined by the exterior wall, such as by a recess and the bathtub wall and similar to the vent opening 182 as described herein.

Figure 6:
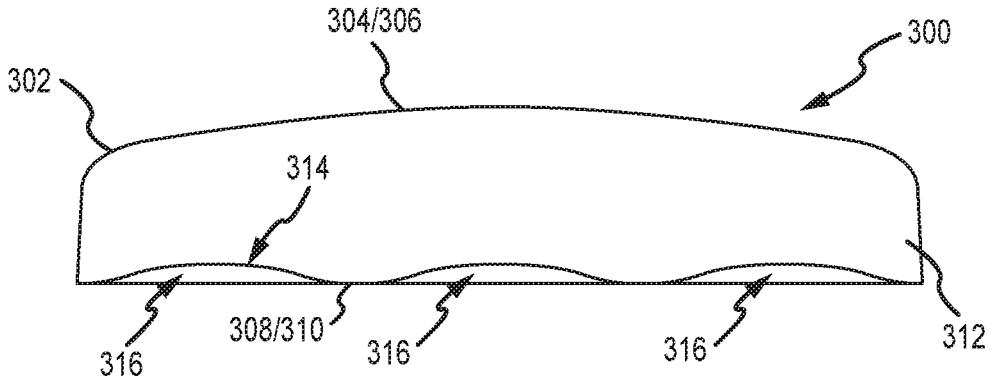
FIG. 6 is a top view of another overflow cover.
Figure 8:
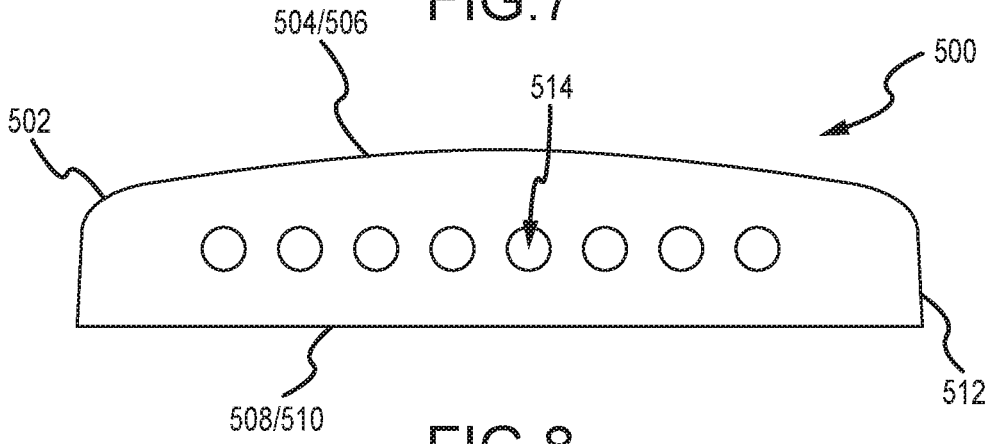
FIG. 8 is a top view of another overflow cover.

In the example, the at least one vent opening 182 is at least partially defined by the exterior wall 206. For example, the at least one vent opening is only partially defined by the exterior wall 206, such as by the recess 194 that is defined at the second end 204. The recess 194 is formed on the mounting surface 212 and extends from the second end 204 towards the first end 202 within the exterior wall 206 and with a substantially arcuate shape extending for a circumferential length 217 around the perimeter 210. The recess 194 is positioned adjacent to the bathtub when in the intended installation position which forms the other boundary of the vent opening 182 as described above. In examples, the vent opening 182 is a single opening that may be positioned above the horizontal centerline 211 and centered about the vertical centerline 213 at the top of the overflow cover 156 so that air pressure may equalize and increase the flow of water through the overflow opening 180. In this example, the vent opening position may be referred to as a 12 o'clock position, and disposed opposite the overflow opening 180. In other examples, the vent opening 182 may be positioned within the body 200 anywhere above the overflow opening 180 in its intended installation position. In yet other examples, the vent opening 182 may be positioned at any location above the horizontal centerline 211 and may be offset from the vertical centerline 213. In examples, the vent opening position may be above the horizontal centerline 211 and between a 9 o'clock position and a 3 o'clock position. In still other examples, in its intended installation position, the vent opening 182 may be positioned above a three-quarter horizontal line 215 (defined as a line parallel to the horizontal centerline 211 and positioned three quarters of the distance between the top-most surface on the body 200 and the horizontal centerline 211), or above a half horizontal line 219 (defined as a line parallel to the horizontal centerline 211 and positioned three quarters of the distance between the top-most surface on the body 200 and the horizontal centerline 211), or above a one-quarter horizontal line 221 (defined as a line parallel to the horizontal centerline 211 and positioned one quarter of the distance between the top-most surface on the body 200 and the horizontal centerline 211). In further examples, the vent opening 182 may include a plurality of discrete openings and as shown in FIGS. 6 and 8, any one or all of which may be positioned in the manners described above. In still further examples, the vent opening may be completely defined by the exterior wall and similar to the overflow opening 180 as described herein. In alternative examples, the vent opening may be formed at the first end 202 of the body 200 between the exterior wall 206 and the face 208.

The exterior wall 206 includes an interior surface 214 that partially defines the interior chamber 184 of the body 200. The interior surface 214 has a projection 216 extending inwards within the interior chamber 184 and around the perimeter 210 of the second end 204. The projection 216 is offset 218 from the mounting surface 212 and is configured to frictionally engage with the lugs on the retainer nut so that the overflow cover 156 may be removably secured to the overflow assembly. In the example, the vent opening 182 extends from the mounting surface 212 to the depth 196 that is less than or equal to the offset distance 218. In other examples, the vent opening 182 may extend from the mounting surface 212 towards the face 208 and past the projection 216. Additionally, the exterior wall 206 may extend for a length 219 from the face 208. In the example, the overflow opening 180 is offset 220 along the length 219 from the vent opening 182. In alternative examples, the overflow opening 180 may be inline along the length 219 with the vent opening 182.

The face 208 includes an interior surface 222 that partially defines the interior chamber 184 of the body 200. The interior surface 222 forms a wall of the first channel 186 and the second channel 190 (both shown in FIG. 4A), and as such, water and/or air flows past the interior surface 222. In some examples, the interior surface 222 may be a substantially smooth surface. In other embodiments, the interior surface 222 may include at least one surface feature 224 as shown in FIG. 5F. The at least one surface feature 224 may influence water and/or air flow through the overflow assembly. More specifically, as the water flows past the at least one surface feature 224, the at least one surface feature 224 is sized and shaped to break a pressure lock within the overflow assembly so that water flow rate through the overflow assembly is increased. In the example, the at least one surface feature 224 includes at least one fin 226. For example, three fins 226 are curved and extend within the overflow cover 156. One fin may be curved upward and the other fin may be curved downward with different curvatures. In other examples, the fins may have similar curvatures. In yet other examples, the fins may have a constant and similar height and/or length, or a variable height and/or length. In yet further examples, the fins may start at an offset position from the exterior wall. Surface features 224 are described further below in reference to FIGS. 9A-15.

FIG. 6 is a top view of another overflow cover 300. In this example, the overflow cover 300 is formed from a body 302 that includes a first end 304 having a face 306 and a second end 308 having a mounting surface 310 with an exterior wall 312 extending therebetween as described above. Additionally, at least one overflow opening (not shown) is defined within the exterior wall 312 and at the bottom of the body 302. However, in this example, a vent opening 314 is only partially defined by the exterior wall 312. The other portion of the vent openings 314 may be defined by the bathtub wall as described above. More specifically, the vent opening 314 may be a plurality of recesses 316 circumferentially spaced at the top of the body 302. The vent openings 314 are substantially arcuate shaped with ends that coincide with the mounting surface 310. In one example, three vent openings 314 are defined with one opening at the apex of the top of the body 302 and two openings equally spaced to either side so as to enable air pressure to equalize within the overflow assembly leading to an increase of water flow through the overflow opening. In other examples, any other size, shape, spacing, and/or number of recesses may form the vent opening 314.

Figure 7:
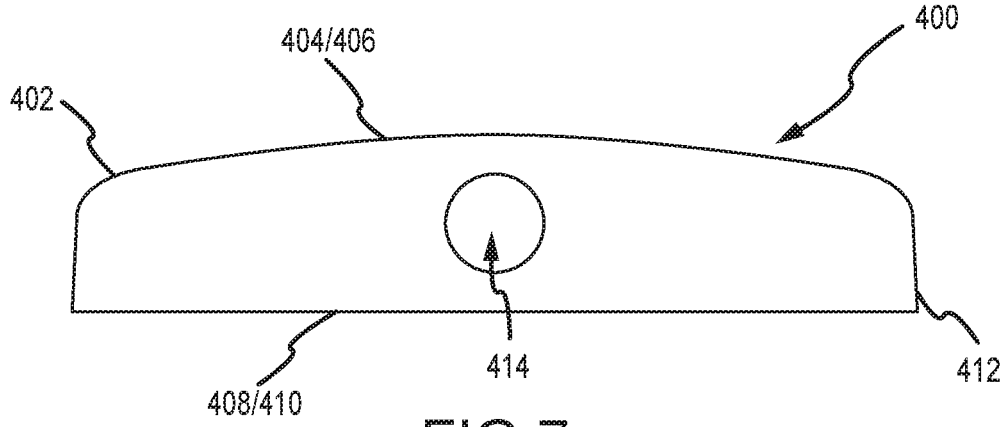
FIG. 7 is a top view of another overflow cover.

FIG. 7 is a top view of another overflow cover 400. In this example, the overflow cover 400 is formed from a body 402 that includes a first end 404 having a face 406 and a second end 408 having a mounting surface 410 with an exterior wall 412 extending therebetween as described above. Additionally, at least one overflow opening (not shown) is defined within the exterior wall 412 and at the bottom of the body 402. However, in this example, a vent opening 414 is completely defined by the exterior wall 412. The vent opening 414 is a single opening and may be substantially circular and positioned between the second end projection (shown in FIG. 5E) and the face 406. In one example, the vent opening 414 is at the apex of the top of the body 302 so as to enable air pressure to equalize within the overflow assembly leading to an increase water flow through the overflow opening. In other examples, any other size, shape, spacing, and/or number of openings may form the vent opening 414.

FIG. 8 is a top view of another overflow cover 500. In this example, the overflow cover 500 is formed from a body 502 that includes a first end 504 having a face 506 and a second end 508 having a mounting surface 510 with an exterior wall 512 extending therebetween as described above. Additionally, at least one overflow opening (not shown) is defined within the exterior wall 512 and at the bottom of the body 502. However, in this example, a vent opening 514 is completely defined by the exterior wall 512. The vent opening 514 may be a plurality of openings and circumferentially spaced at the top of the body 502. The vent openings 514 are substantially circular and positioned between the second end projection (shown in FIG. 5E) and the first end 504. In one example, the vent openings 514 are defined by eight openings spaced about the apex of the top of the body 502 so as to enable air pressure to equalize within the overflow assembly leading to an increase water flow through the overflow opening. In other examples, any other size, shape, spacing, and/or number of openings may form the vent opening 514.

Figure 9A:
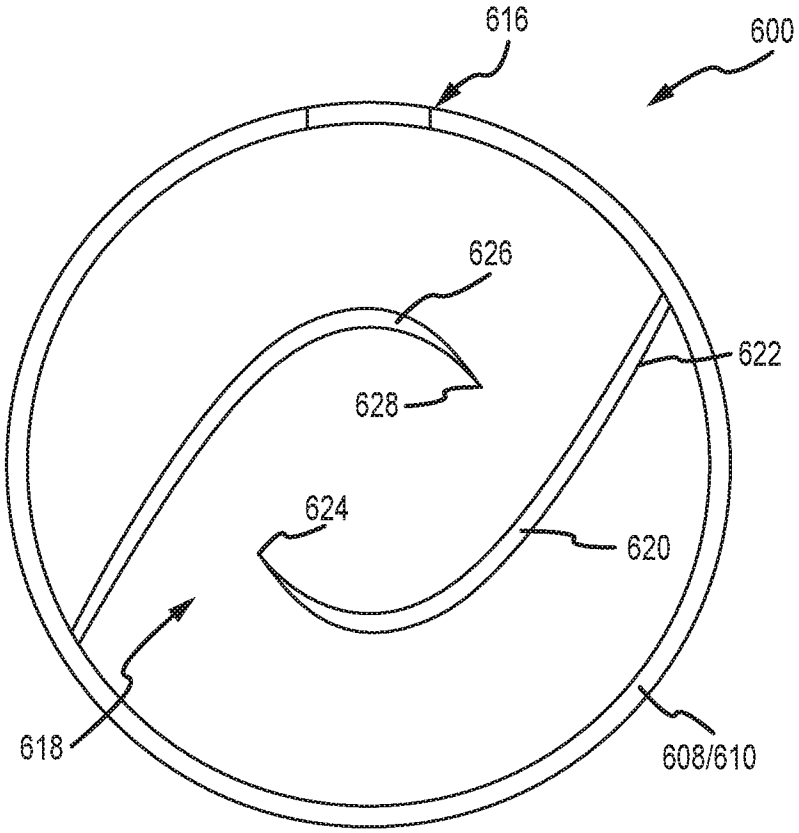
FIGS. 9A and 9B are interior and cross-sectional views, respectively, of another overflow cover.
Figure 9B:
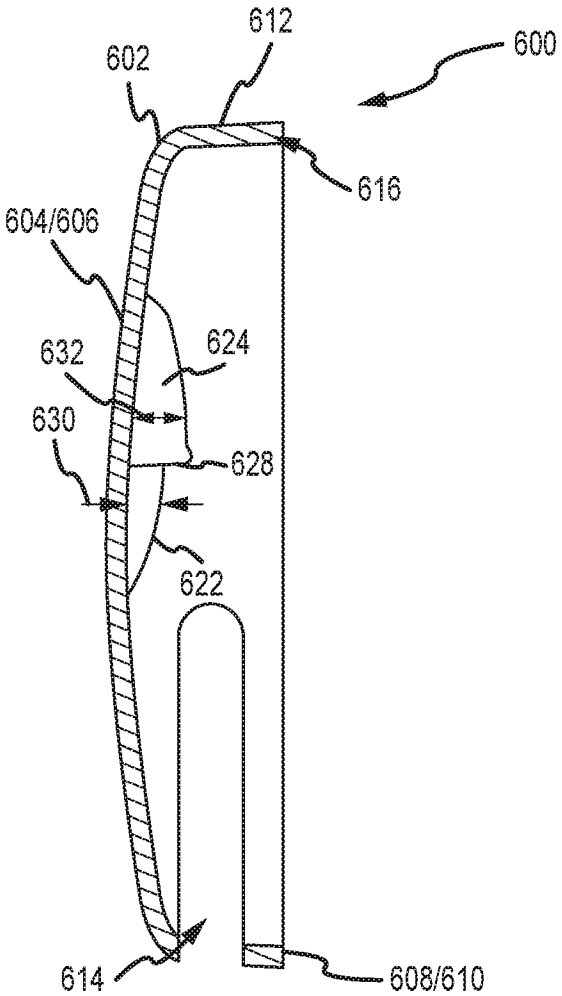

FIGS. 9A and 9B are interior and cross-sectional views, respectively, of another overflow cover 600. In this example, the overflow cover 600 is formed from a body 602 that includes a first end 604 having a face 606 and a second end 608 having a mounting surface 610 with an exterior wall 612 extending therebetween as described above. Additionally, at least one overflow opening 614 is completely defined by the exterior wall 612 and at the bottom of the body 602 and at least one vent opening 616 is only partially defined by the exterior wall 612 and at the top of the body 602. However, in this example, an interior surface 618 includes a surface feature 620 that has a first fin 622 extending from the exterior wall 612 into the center of the overflow cover 600, terminating at a curved tip 624 and a second fin 626 extending from the exterior wall 612 into the center of the overflow cover 600, terminating at a curved tip 628. The first fin 622 may be a smaller height 630 that a height 632 of the second fin 626. In alternative examples, the fins 622, 626 may have substantially equal heights. In other examples, the fins may be offset from the exterior walls.

Figure 10:
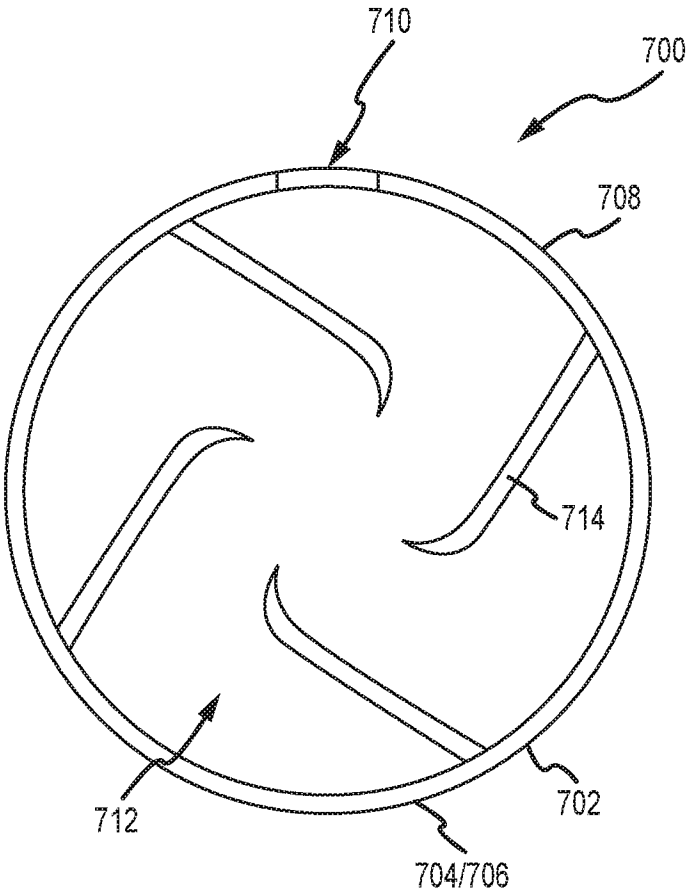
FIG. 10 is an interior view of another overflow cover.

FIG. 10 is an interior view of another overflow cover 700. In this example, the overflow cover 700 is formed from a body 702 that includes a second end 704 having a mounting surface 706, an exterior wall 708, and at least one vent opening 710 that is only partially defined by the exterior wall 708 and at the top of the body 702 as described above. However, in this example, an interior surface 712 includes a surface feature 714 that has four fins with curved tips circumferentially spaced within the body 702. In other examples, each fin may have different shapes and/or the surface feature may have a lower or higher number of fins.

Figure 11:
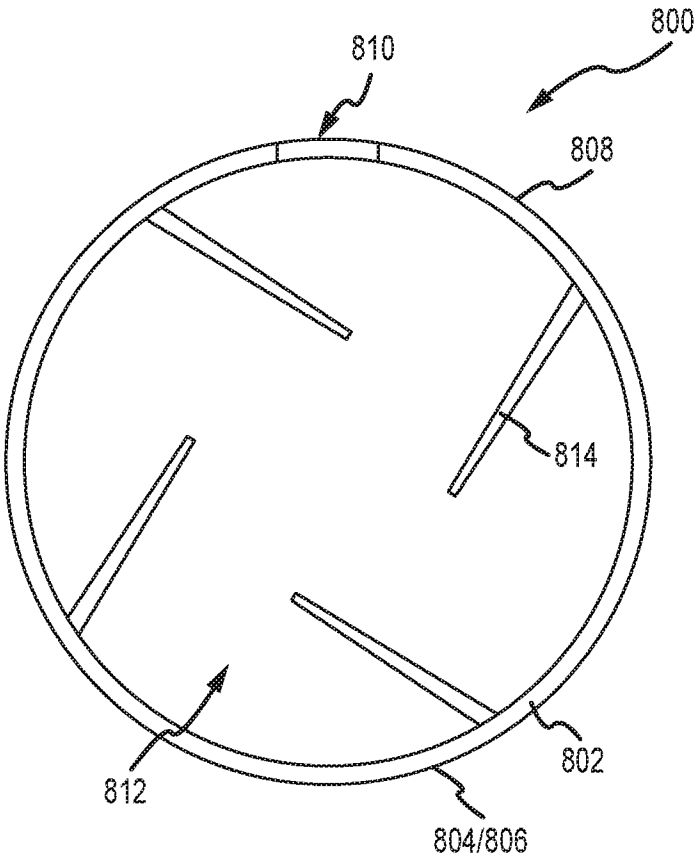
FIG. 11 is an interior view of another overflow cover.

FIG. 11 is an interior view of another overflow cover 800. In this example, the overflow cover 800 is formed from a body 802 that includes a second end 804 having a mounting surface 806, an exterior wall 808, and at least one vent opening 810 that is only partially defined by the exterior wall 808 and at the top of the body 802 as described above. However, in this example, an interior surface 812 includes a surface feature 814 that has four fins with straight tips circumferentially spaced within the body 802. In other examples, each fin may have different shapes and/or the surface feature may have a lower or higher number of fins.

Figure 12:
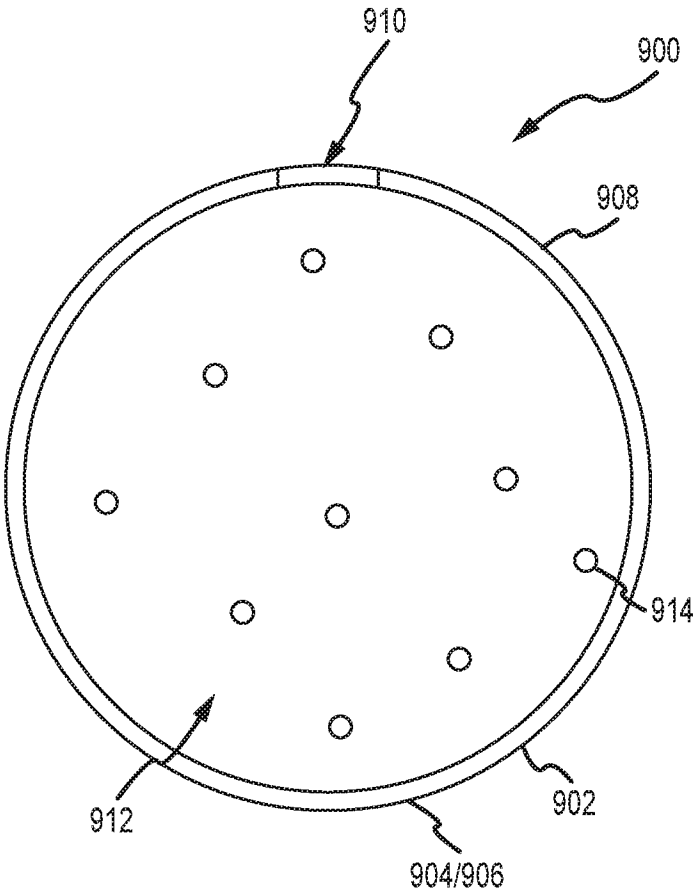
FIG. 12 is an interior view of another overflow cover.

FIG. 12 is an interior view of another overflow cover 900. In this example, the overflow cover 900 is formed from a body 902 that includes a second end 904 having a mounting surface 906, an exterior wall 908, and at least one vent opening 910 that is only partially defined by the exterior wall 908 and at the top of the body 902 as described above. However, in this example, an interior surface 912 includes a surface feature 914 that has a textured surface. For example, the textured surface may be similar to that of golf ball dimples. The textured surface may be included over the entire interior surface 912 or may be included on only a portion as required or desired. In other examples, the textured surface has any other configuration that enables the overflow cover to function as described herein.

Figure 13:
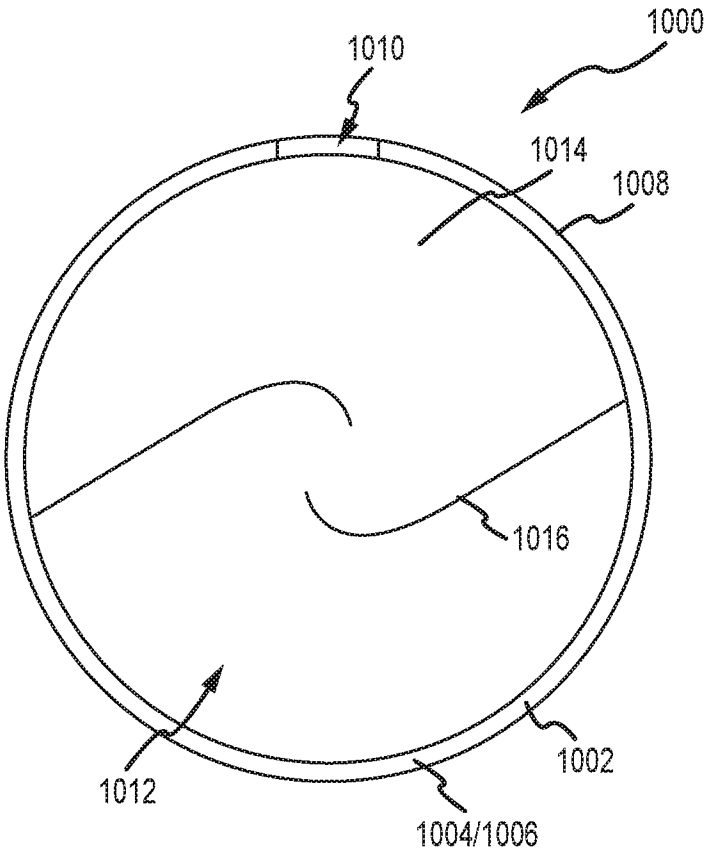
FIG. 13 is an interior view of another overflow cover.

FIG. 13 is an interior view of another overflow cover 1000. In this example, the overflow cover 1000 is formed from a body 1002 that includes a second end 1004 having a mounting surface 1006, an exterior wall 1008, and at least one vent opening 1010 that is only partially defined by the exterior wall 1008 and at the top of the body 1002 as described above. However, in this example, an interior surface 1012 has a surface feature that includes a textured surface 1014 as described above and at least one fin 1016 also as described above. In other examples, the fins 1018 may have any other configuration that enables the overflow cover to function as described herein.

Figure 14:
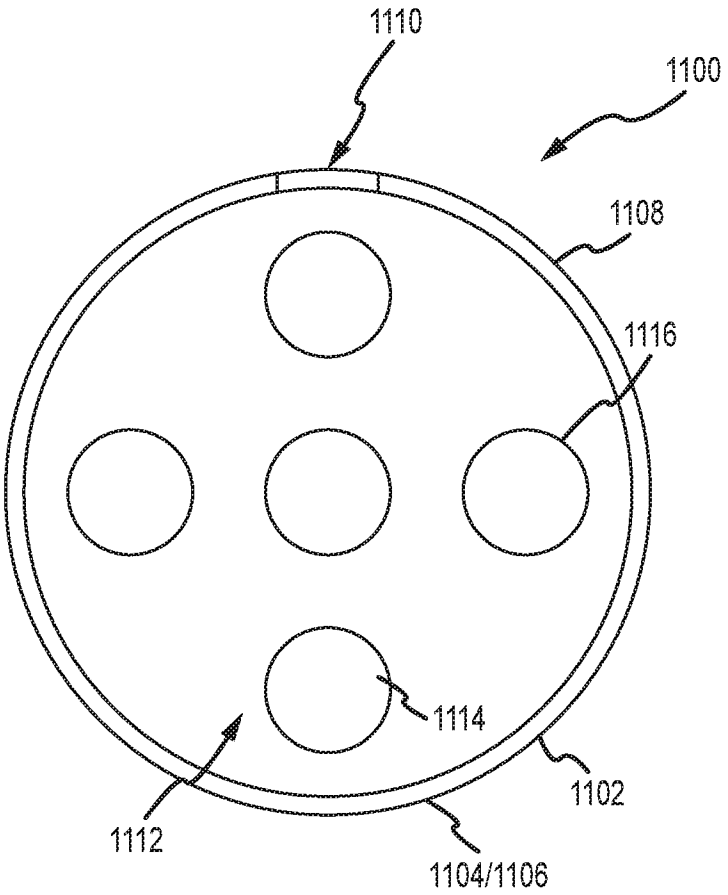
FIG. 14 is an interior view of another overflow cover.

FIG. 14 is an interior view of another overflow cover 1100. In this example, the overflow cover 1100 is formed from a body 1102 that includes a second end 1104 having a mounting surface 1106, an exterior wall 1108, and at least one vent opening 1110 that is only partially defined by the exterior wall 1108 and at the top of the body 1102 as described above. However, in this example, an interior surface 1112 includes a surface feature 1114 that has a textured surface that has at least one dimple 1116 that is larger than the surface feature shown in FIG. 12.

Figure 15:
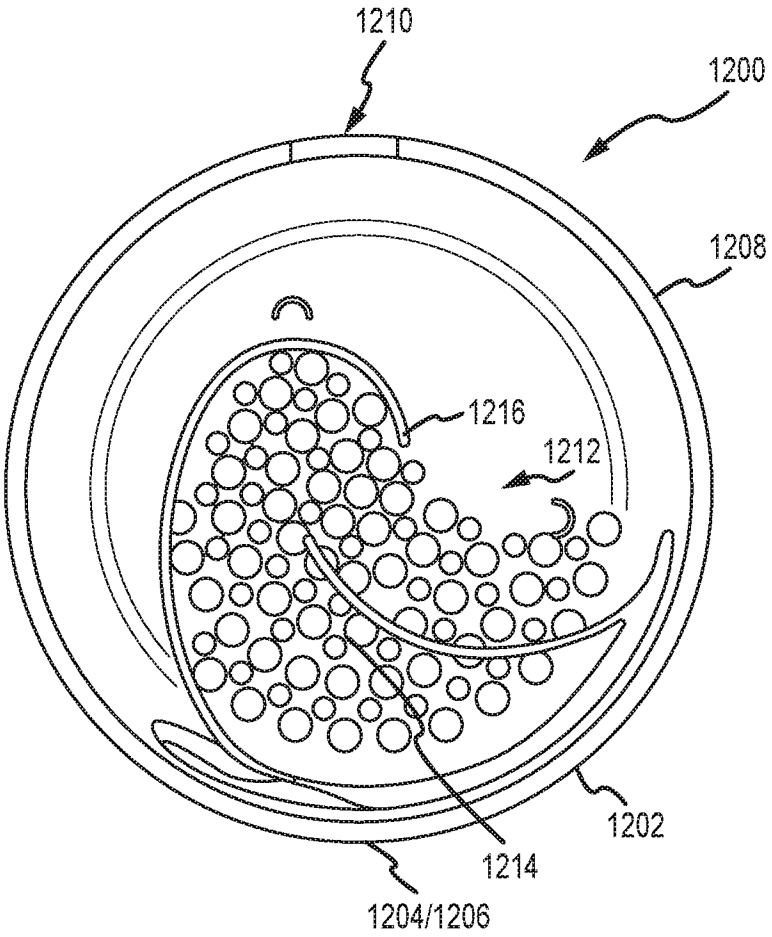
FIG. 15 is an interior view of another overflow cover.

FIG. 15 is an interior view of another overflow cover 1200. In this example, the overflow cover 1200 is formed from a body 1002 that includes a second end 1204 having a mounting surface 1206, an exterior wall 1208, and at least one vent opening 1210 that is only partially defined by the exterior wall 1208 and at the top of the body 1202 as described above. However, in this example, an interior surface 1212 has a surface feature that includes a textured surface 1214 covering only a lower portion of the interior surface 1212 and a pair of fins 1216. In other examples, the textured surface may cover any other portion of the interior surface, such as an upper portion, a center portion, a left portion, or a right portion, when the overflow cover is in its intended installed position.

Figure 16:
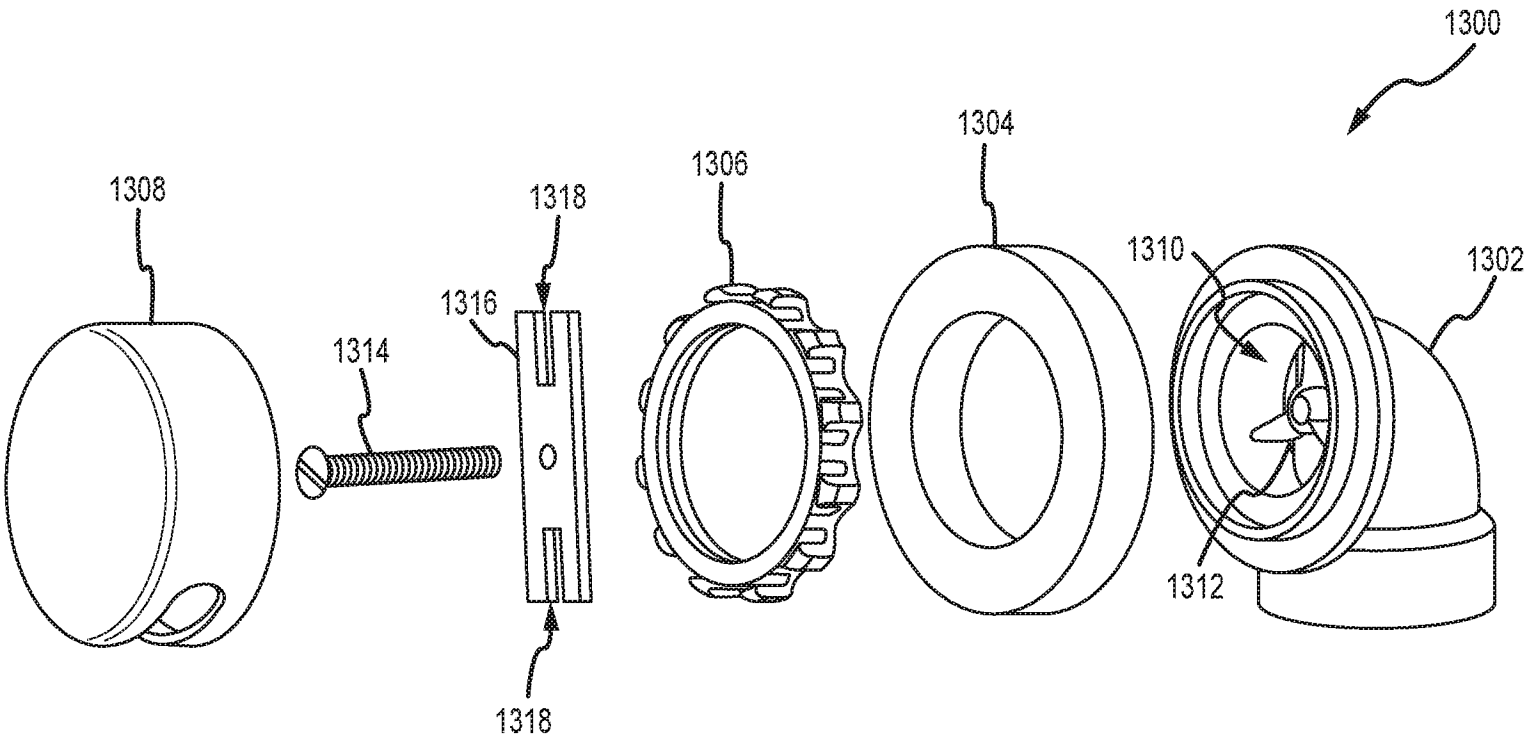
FIG. 16 is an exploded perspective view of another overflow assembly.

FIG. 16 is an exploded perspective view of another overflow assembly 1300. The overflow assembly 1300 includes an overflow elbow 1302, a seal 1304, a retainer nut 1306, and an overflow cover 1308 as described above. However, in this example, an inlet end 1310 of the elbow 1302 includes a receiver 1312 disposed therein. The receiver 1312 is configured to receive a fastener 1314 so that a bracket 1316 may compress the retainer nut 1306, the seal 1304, and a bathtub wall (not shown) into the elbow 1302 and the retainer nut 1306 is secured in relation to the elbow 1302. The bracket 1316 enables the retainer nut 1306 and the overflow cover 1308 to be retrofitted onto other overflow systems, which are not threaded and which typically attach the cover via a fastener on the front, without having to replace the entire overflow system and open up the wall behind the bathtub. The bracket 1316 also includes two channels 1318 on either end so that the bracket 1316 may secure to a receiver 1312 that is configured for two fasteners.

The materials utilized in the manufacture of the overflow assembly and overflow covers described herein may be those typically utilized for plumbing and trim kits, e.g., brass, chrome, zinc, steel, aluminum, stainless steel, copper, etc. Molded plastics, such as acrylonitrile butadiene styrene (ABS), polyvinyl chloride (PVC), flexible PVC, polyethylene, etc., may be utilized for various components as well. Material selection for most of the components may be based on the proposed use and desired finish of the overflow assembly and overflow covers.

It will be clear that the systems and methods described herein are well adapted to attain the ends and advantages mentioned as well as those inherent therein. Those skilled in the art will recognize that the methods and systems within this specification may be implemented in many manners and as such is not to be limited by the foregoing exemplified embodiments and examples. In this regard, any number of the features of the different embodiments described herein may be combined into one single embodiment and alternate embodiments having fewer than or more than all of the features herein described are possible. While various embodiments have been described for purposes of this disclosure, various changes and modifications may be made which are well within the scope contemplated by the present disclosure.

What is claimed is:

1. An overflow assembly for a bathtub comprising:
- an elbow comprising a first threaded section;
- a retainer nut comprising a second corresponding threaded section and a plurality of radially extending lugs, wherein at least one of the plurality of radially extending lugs has a first circumferential length, and wherein the retainer nut is configured to threadably mount onto the elbow with a bathtub wall therebetween; and
- an overflow cover comprising:
  - an enclosed first end;
  - an open second end;
  - a wall extending between the first end and the second end that is engageable with the plurality of radially extending lugs;
  - at least one overflow opening; and
  - at least one vent opening disposed proximate the second end, wherein the at least one vent opening has a second circumferential length that is greater than the first circumferential length.

2. The overflow assembly of claim 1, wherein when the overflow cover is engaged with the retainer nut, the retainer nut is disposed within the overflow cover and a gap is formed between the overflow cover and the retainer nut so that air can flow out of the elbow and through the at least one vent opening.

3. The overflow assembly of claim 1, wherein when the overflow cover is engaged with the retainer nut, the retainer nut is disposed within the overflow cover and at least partially blocking the at least one vent opening.

4. The overflow assembly of claim 1, wherein the at least one vent opening has a depth and the retainer nut has a thickness, and wherein the depth of the at least one vent opening is less than the thickness of the retainer nut.

5. The overflow assembly of claim 1, wherein the at least one vent opening is only partially defined within the overflow cover.

6. The overflow assembly of claim 5, wherein the at least one vent opening has a substantially arcuate shape.

7. The overflow assembly of claim 1, wherein the overflow cover comprises an interior surface with an inwardly extending projection disposed proximate the second end, wherein the projection is configured to frictionally engage with the plurality of radially extending lugs.

8. The overflow assembly of claim 7, wherein the second end comprises a mounting surface and the projection is offset from the mounting surface, and wherein a depth of the at least one vent opening is less than or equal to the offset between the mounting surface and the projection.

9. The overflow assembly of claim 7, wherein the at least one overflow opening is disposed between the projection and the first end.

10. The overflow assembly of claim 1, wherein when the overflow cover is engaged with the retainer nut, the at least one vent opening is formed between the bathtub wall and the overflow cover.

11. An overflow cover comprising:

a face having an interior surface;

a substantially cylindrical exterior wall extending from the face, wherein an end of the exterior wall defines a mounting surface that is configured to be positioned against a bathtub wall when the overflow cover is mounted over an overflow port, and wherein an interior chamber is defined by the interior surface of the face and the exterior wall;

at least one overflow opening at least partially defined by the exterior wall; and at least one fin extending from the interior surface of the face and completely within the interior chamber, wherein the at least one fin extends from and is directly attached to the exterior wall and terminates at a tip that is offset from the exterior wall.

12. The overflow cover of claim 11, wherein the at least one fin is curved.

13. The overflow cover of claim 11, wherein the at least one fin comprises two fins, with each fin having a different height from the interior surface of the face.

14. The overflow cover of claim 11, wherein the at least one fin comprises two fins, with each fin having a substantially similar height from the interior surface of the face.

15. The overflow cover of claim 11, wherein the interior surface of the face comprises an at least partially textured surface.

16. The overflow cover of claim 11, further comprising at least one vent opening.

17. An overflow cover comprising:

a face;

a wall extending from the face, wherein an end of the wall opposite the face defines a mounting surface that is configured to be positioned proximate a bathtub when the overflow cover is mounted to an overflow port, and wherein the wall includes at least one projection extending from the wall and offset from the mounting surface;

at least one overflow opening at least partially defined by the wall; and at least one vent opening having a recess formed on the mounting surface and extending towards the face, wherein the at least one vent opening extends from the mounting surface to a depth that is less than or equal to the offset of the at least one projection.

18. The overflow cover of claim 17, wherein the overflow cover is sized and shaped to be mounted to the overflow port using a retainer nut that engages the overflow port, and wherein the at least one projection engages the retainer nut when the overflow cover is mounted to the overflow port.

19. The overflow cover of claim 17, wherein the at least one overflow opening is substantially opposite of the at least one vent opening on the wall.

* * * * *